US006718938B2

(12) United States Patent
Szorenyi

(10) Patent No.: US 6,718,938 B2
(45) Date of Patent: Apr. 13, 2004

(54) HINGED ROTOR INTERNAL COMBUSTION ENGINE

(76) Inventor: Peter Szorenyi, 41 Birdwood Street, Hughes, ACT (AU), 2605

( * ) Notice: Subject to any disclaimer, the term of this patent is extended or adjusted under 35 U.S.C. 154(b) by 0 days.

(21) Appl. No.: 10/149,913

(22) PCT Filed: May 11, 2001

(86) PCT No.: PCT/AU01/00544

§ 371 (c)(1),
(2), (4) Date: Jun. 13, 2002

(87) PCT Pub. No.: WO01/88341

PCT Pub. Date: Nov. 22, 2001

(65) Prior Publication Data

US 2002/0189578 A1 Dec. 19, 2002

(51) Int. Cl.[7] ..... F02B 53/00
(52) U.S. Cl. ..... 123/241; 123/200
(58) Field of Search ..... 123/200, 241; 418/270

(56) References Cited

U.S. PATENT DOCUMENTS 3,139,722 A * 7/1964 Yokoi
3,295,505 A * 1/1967 Jordan ..... 123/241
3,369,529 A * 2/1968 Jordan
3,387,596 A * 6/1968 Niemand ..... 418/104
3,642,391 A * 2/1972 Wilson
3,872,852 A * 3/1975 Gilbert
3,918,415 A * 11/1975 Ishida
4,181,481 A * 1/1980 Jordan
5,397,224 A * 3/1995 Bando et al.
6,164,263 A * 12/2000 Saint-Hilaire et al.

FOREIGN PATENT DOCUMENTS

DE 2 321 763 * 11/1974
GB 1 521 960 * 8/1978

* cited by examiner

*Primary Examiner*—Hoang Nguyen
(74) *Attorney, Agent, or Firm*—Larson & Taylor PLC

(57) ABSTRACT

A rotary internal combustion engine comprises a four-segment hinged rotor assembly accommodated in a coaxial housing such that the rotor assembles deforms and continuously adapts to the housing internal profile during its rotation. The closed non-circular rotor housing internal profile is a curve defined by a novel mathematical relationship. The curve is the locus of all points generated by the base extremities A and B of an isosceles right angle translating and simultaneously rotating triangle with the following constraints. The center point P of the base AB (of length c) of the triangle must always be located on an inscribed circle of radius c/2 and center at point O. The vertex C of the triangle must always be located on one of the four lobes of the curve of the form r=sin(2θ) where angle θ is the angle between line OA and the positive vertical (y) axis and also line OB and the positive horizontal (x) axis.

22 Claims, 21 Drawing Sheets

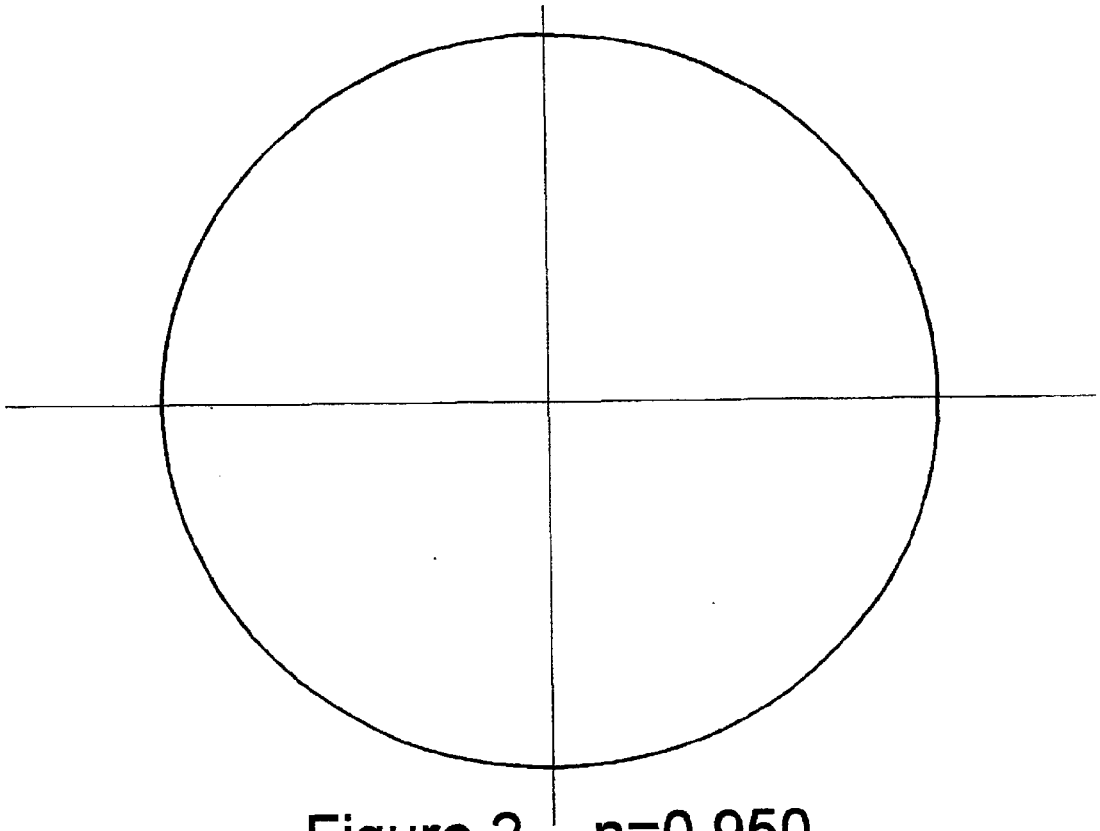
Figure 2. n=0.950
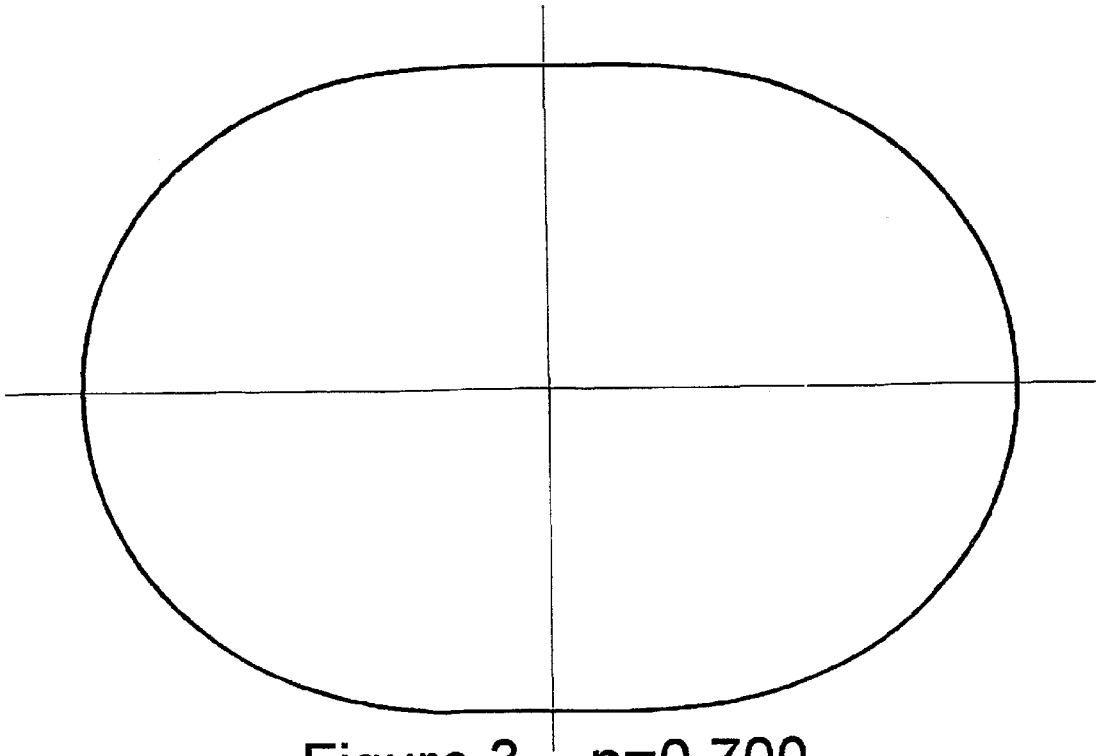
Figure 3. n=0.700

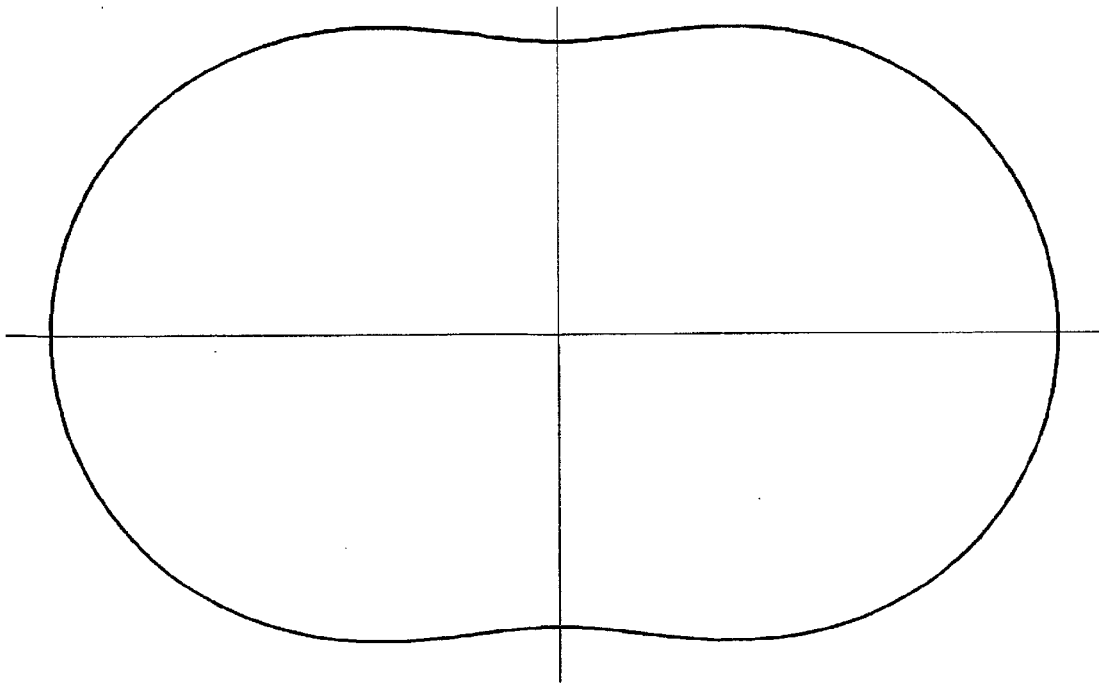
Figure 4. n=0.585
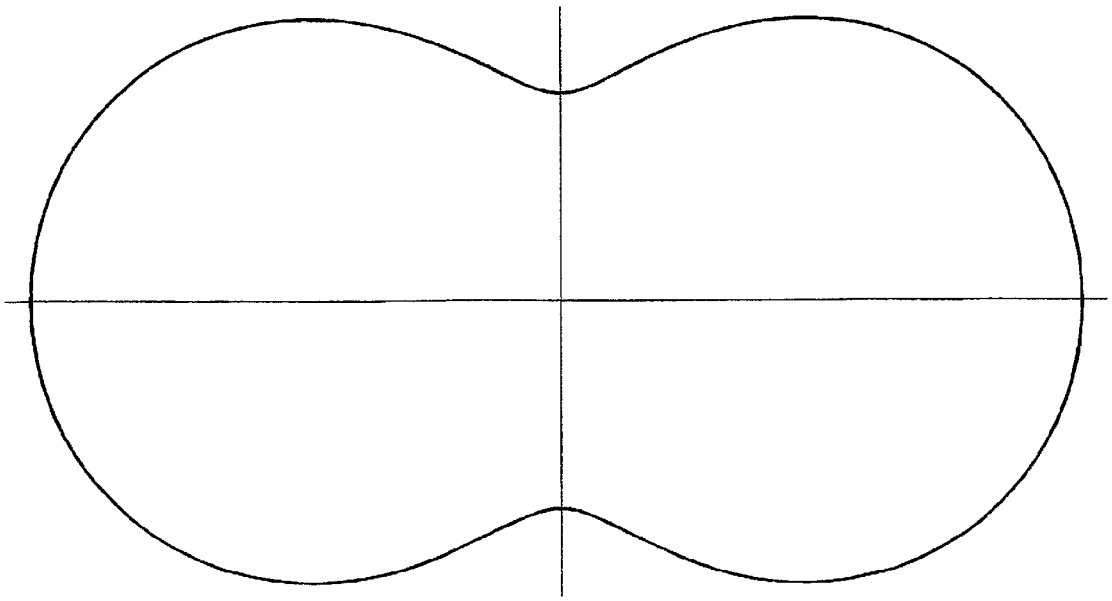
Figure 5. n=0.400

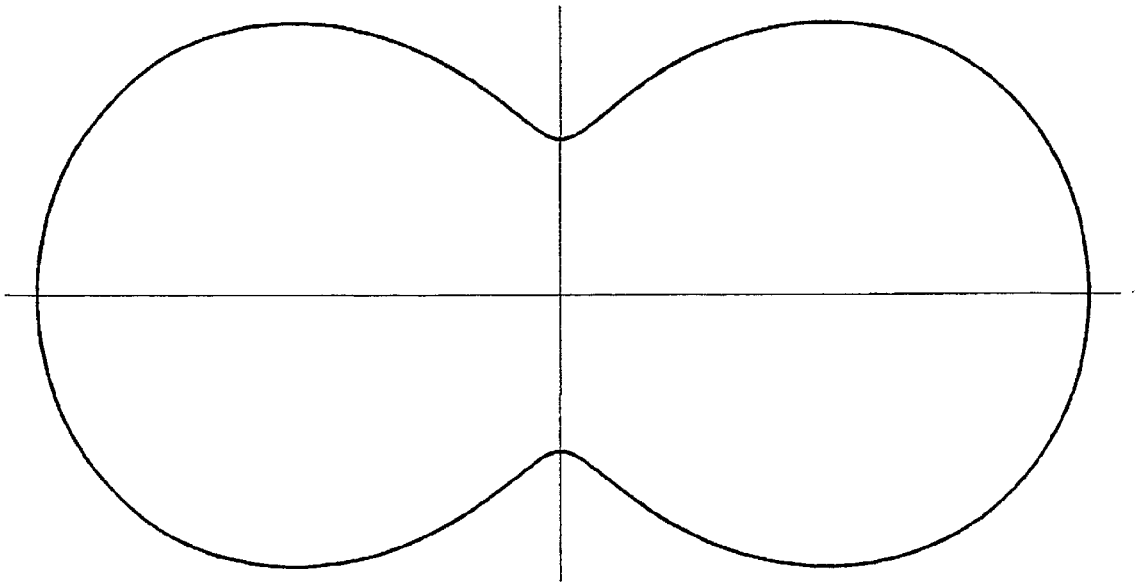
Figure 6. n=0.300
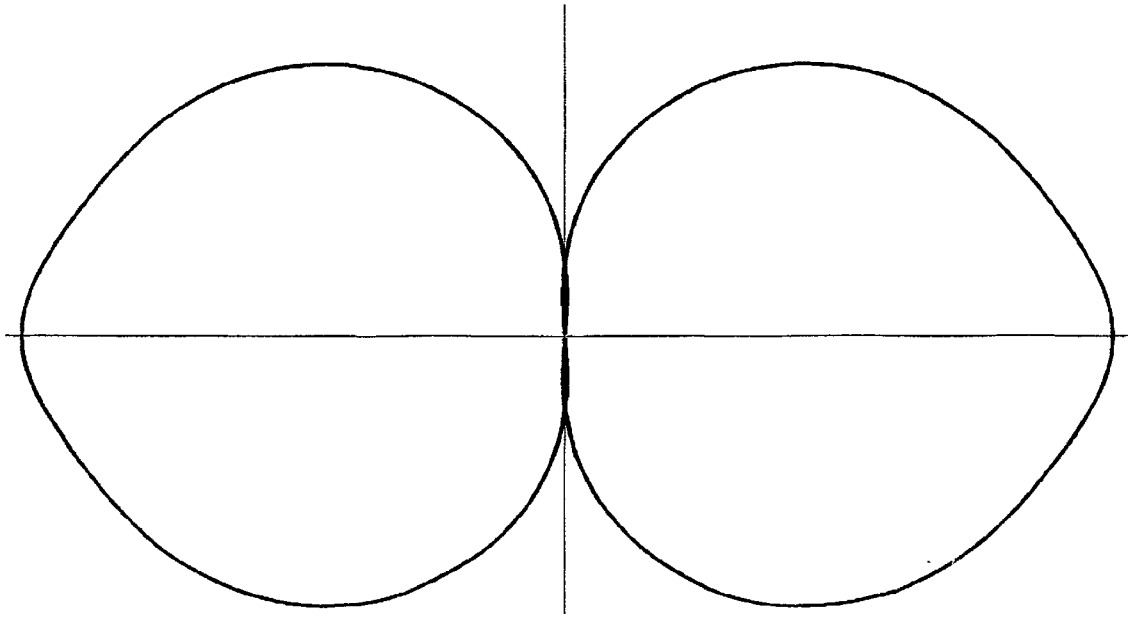
Figure 7. n=0.005

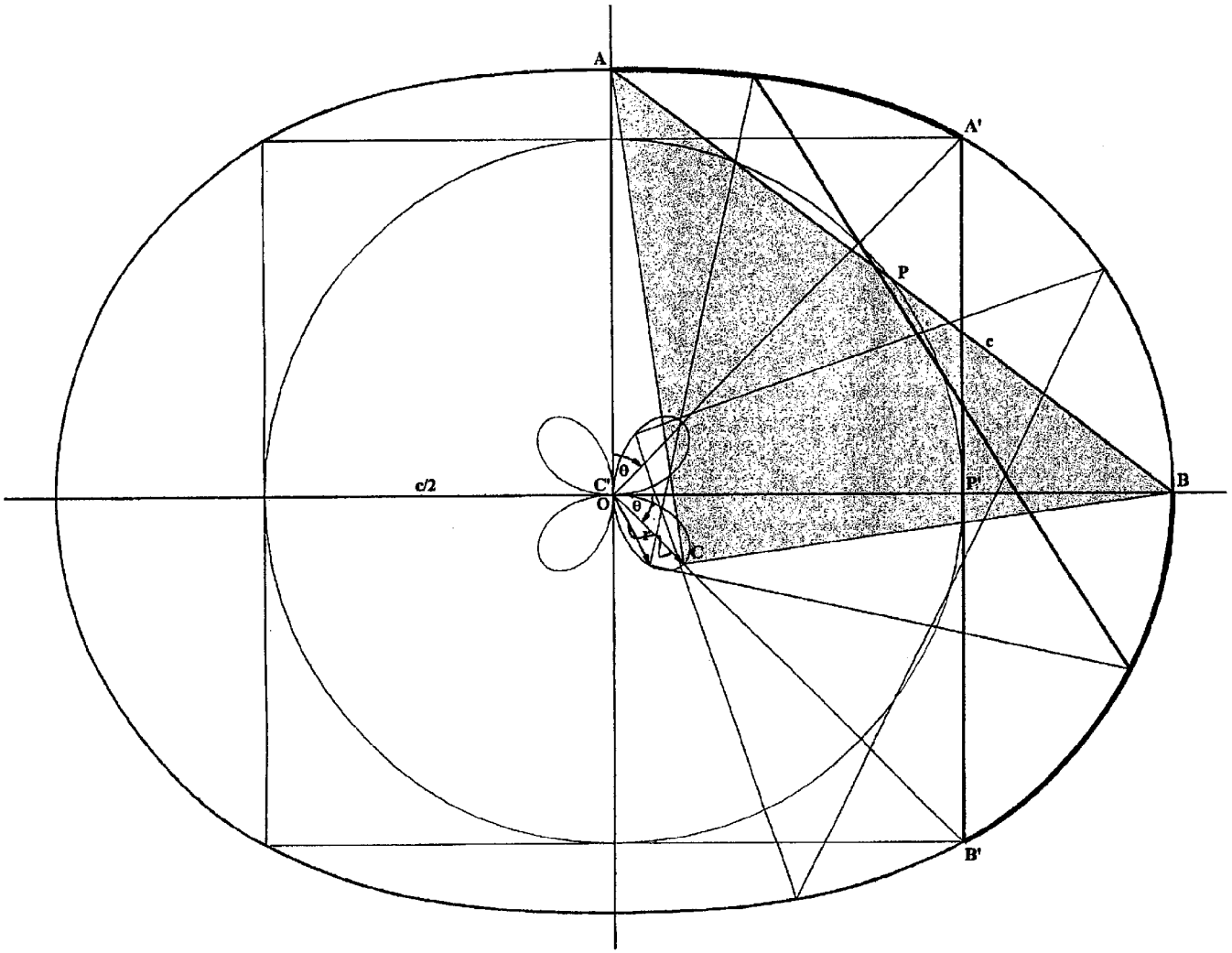
Figure 8. Curve Construction Diagram

HINGED ROTOR INTERNAL COMBUSTION ENGINE

FIELD OF THE INVENTION

This invention is in the field of rotary internal combustion engines utilising a flexible, hinged rotor assembly. The rotor assembly is confined by a coaxial housing whose internal profile is derived from an exact mathematical relationship. The engine utilises a synchronised power transfer system whereby the rotor directly bears on the crankshaft.

PRIOR ART DISCLOSURE

Documents containing related art include U.S. Pat. Nos. 3,139,722; 3,369,529; 3,872,852; 3,918,415; 4,181,481; GB Patent Nos. 1,289,479; 1,521,960; DE 2,321,763; CA 2,192,714 and EP0571637. The cited patents relate to internal combustion engine designs based on rigid (eg. Wankel) and flexible rotor assemblies contained in a coaxial housing.

SUMMARY OF THE INVENTION

This invention discloses the exact mathematical definition of the housing profile, required to accommodate a four-segment flexible, or hinged, rotor assembly at any rotational angle. The novel mathematical relationship is applicable to the design and manufacture of said rotor assembly housings. The specification for a synchronised, direct power transfer system is also described. Such a power transfer system harmonises the rotation of the hinged rotor assembly with the rotation of the crankshaft.

BRIEF DESCRIPTION OF THE DRAWING

FIGS. 2 to 7 are graphical illustrations of a number of Szorenyi's curve profiles for a selection of major-to-minor diameter ratios.

FIG. 8 is a graphical illustration of precise details of Szorenyi's curve construction geometry.

DESCRIPTION OF THE INVENTION

Figure 1:
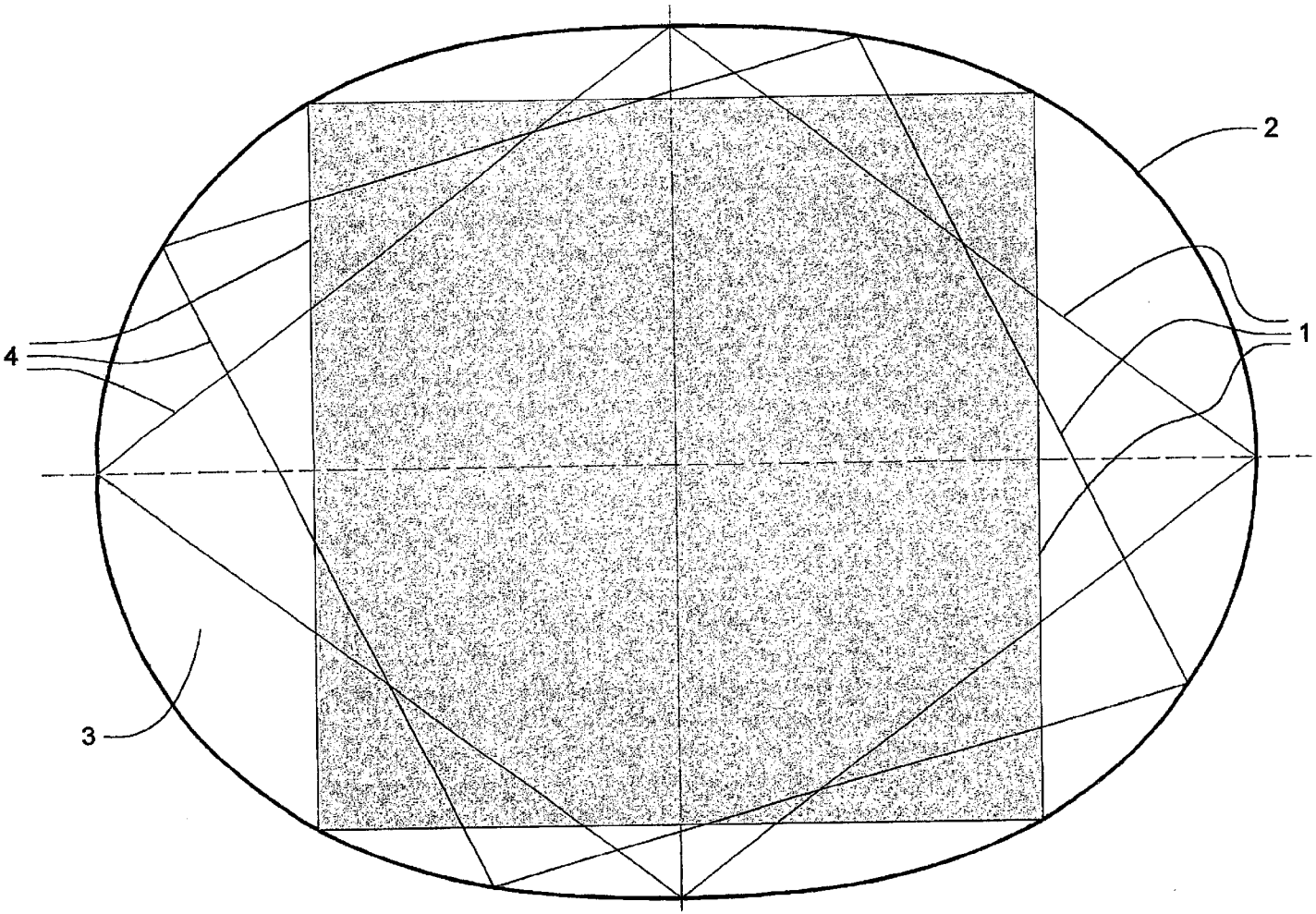
FIG. 1 is a graphical illustration of the basic concept of a four-segment hinged rotor assembly that changes from a square configuration to a rhombic one as it rotates and while its vertices follow a profile defined by the Szorenyi's curve formula of the present invention.

This invention concerns the design of an Otto cycle (four-stroke) rotary internal combustion engine employing the concept of a deformable four-segment hinged rotor assembly. The underlying principle consists of accommodating the four-segment equilateral hinged rotor in a coaxial confinement housing such that the four vertices of this rotating equilateral parallelogram coincide with the confining curve (rotor housing internal contour) at any angle of rotation. The basic concept is illustrated in FIG. 1. During its rotation, the four-segment rotor assembly 1 deforms and continuously adapts to the rotor housing 2 contour. As the hinged equilateral parallelogram rotates, it changes from a square to a rhombus and then back to a square, and so on. In the process of continuous rotor deformation, the volume enclosed between the rotor housing flat-plate side covers 3, rotor housing 2 and each individual rotor segment face 4, cyclically varies from a minimum to a maximum. The successive expansion and contraction of the enclosed volumes enables the device to perform the Otto cycle internal combustion engine functions of intake, compression, expansion and exhaust.

The rotor housing curve or internal profile is defined by a novel mathematical relationship and is described in detail in the text. The curve will be known as Szorenyi's curve, named after the inventor who is believed to be the first to recognise this mathematical relationship. The characteristics of the rotor housing curve depend on the ratio n of rotor housing minor to major internal diameters (adopting ellipse terminology). In the case of a one-to-one correspondence of these diameters, the curve is a circle with no practical motor application in that there is no cyclic volume change generated by rotation of the rotor. As the ratio of minor to major diameters n decreases, the curve assumes more of an elliptical shape and, for the three-dimensional case, the ratio of maximum enclosed volume to minimum enclosed volume increases. The limiting case, as n approaches zero, becomes a shape resembling two conjoint circles, or a dividing cell. For the intermediate ratios of n, there is considerable variation in the curve's characteristics, as illustrated in FIGS. 2 to 7. Below a minor to major diameter ratio of approximately 0.625, the curve begins to exhibit central intrusions along the minor axis. Such "pinched" housing configurations provide larger intake/expansion chamber volumes and would be particularly suited for diesel applications where compression ratios exceeding 20:1 may be required.

The engine employs a unique system of synchronised, direct power take-off whereby the rotor directly bears on the crankshaft. The synchronised direct power transfer system harmonises the rotation of the hinged rotor assembly with the rotation of the crankshaft. Implementation of the arrangement comprises a single-piece crankshaft whose rotation is synchronised with the rotor assembly apices. Power transfer is effected by the rotor segments directly and constantly bearing on crankshaft crankpins. The crankshaft is only in sliding contact with rotor segments and is thus decoupled in the axial direction.

The principle of enclosed volume variation described herein is also applicable to pumps, compressors, hydraulic motors and other mechanisms where a working chamber volume cyclic change from a maximum to a minimum is utilised. A two-stroke engine variant is also feasible, provided that each of the intake/compression and expansion/exhaust phases is completed in a quarter (90 degrees) rotation of the four-segment hinged rotor assembly. In the Otto cycle variant, each of the intake/compression and expansion/exhaust phases is completed in a half (180 degrees) rotation of the four-segment rotor assembly.

Description of Generating Szorenyi's Curve

Szorenyi's curve is generated by the trajectory of the base extremities (points A and B) of an isosceles right-angle translating and simultaneously rotating triangle. FIG. 8, to scale, provides a graphical representation of the general construction method. In this example, the ratio of minor radius OA to major radius OB is 0.75 (i.e. n=0.75). Szorenyi's curve is defined as the locus of all points A' and B' generated by the translating and rotating triangle ABC with the following constraints satisfied:

- the base length c of the isosceles right-angle generating triangle ABC equals one side of the equilateral parallelogram (or the length of one of the four identical rotor segments) that is continuously accommodated within the confines of the rotor housing having a Szorenyi's curve profile);
- the centre point P of the base AB (length c) of the isosceles right-angle generating triangle ABC must always be located on the inscribed circle of radius c/2 and centre at point O; and
- the vertex of the generating triangle (C) must always be located on one of the four lobes of the curve of the general form:

$$a=\sin(2\alpha)$$

a "four-leaf rose" curve, with its origin at the centre point O of the rotor housing and nulls along the axes Referring to FIG. 8, the specific form of the curve is:

$$|r|=\sin[2(\theta+45°)]$$

where the angle θ(such that $0° \leqq \theta \leqq 360°$) is the angle between line OA and the positive vertical (y) axis and also line OB and the positive horizontal (x) axis.

With the above constraints observed and, as the angle θ is varied, pairs of points are generated on Szorenyi's curve. For example, the clockwise rotation of lines OA and OB through an angle θ from 0 to 45 degrees would result in the movement of the generating triangle apices from point A to point A' and point B to point B' along the curve, and point C to point C' (which now coincides with the origin O) along one of the lobes of the "four-leaf rose". In this process, |r| the absolute value, or length, of parameter r of the polar "four-leaf rose" curve changes from its maximum value of r {when θ=0° and sin[2(θ+45°)]=1} to zero {when θ=45° and sin[2(θ+45°)]0}. It should be noted that r equals the length of line OC (or OC' as the generating triangle translates/rotates). The centre point P of the generating triangle base AB also moves to point P' along the inscribed circle of radius c/2 and centre at O.

Szorenyi's curve is additionally characterised by the property that line OA is perpendicular to line OB and, similarly, every line OA' is perpendicular to its corresponding pair, line OB'.

While A traverses to A' and B traverses to B', segments of Szorenyi's curve are traced out, indicated by the extra heavy lines in FIG. 8. By symmetry, these two segments AA' and BB' define the total closed curve, which can now be completed by multiple mirror image transformations of segments AA' and BB' about the x and y axes. Therefore, there is no real requirement for θ to traverse the rest of the full range from 45° to 360° to define the complete closed curve.

Szorenyi's curves are fully characterised by only two parameters; namely the minor and major diameters (or minor and major radii). Computer code, embodying the above mathematical relationships defining Szorenyi's curve, is applied to generate exact housing profiles for any user-defined minor to major rotor housing diameter ratio.

Modified Szorenyi's Curve

Figure 9:
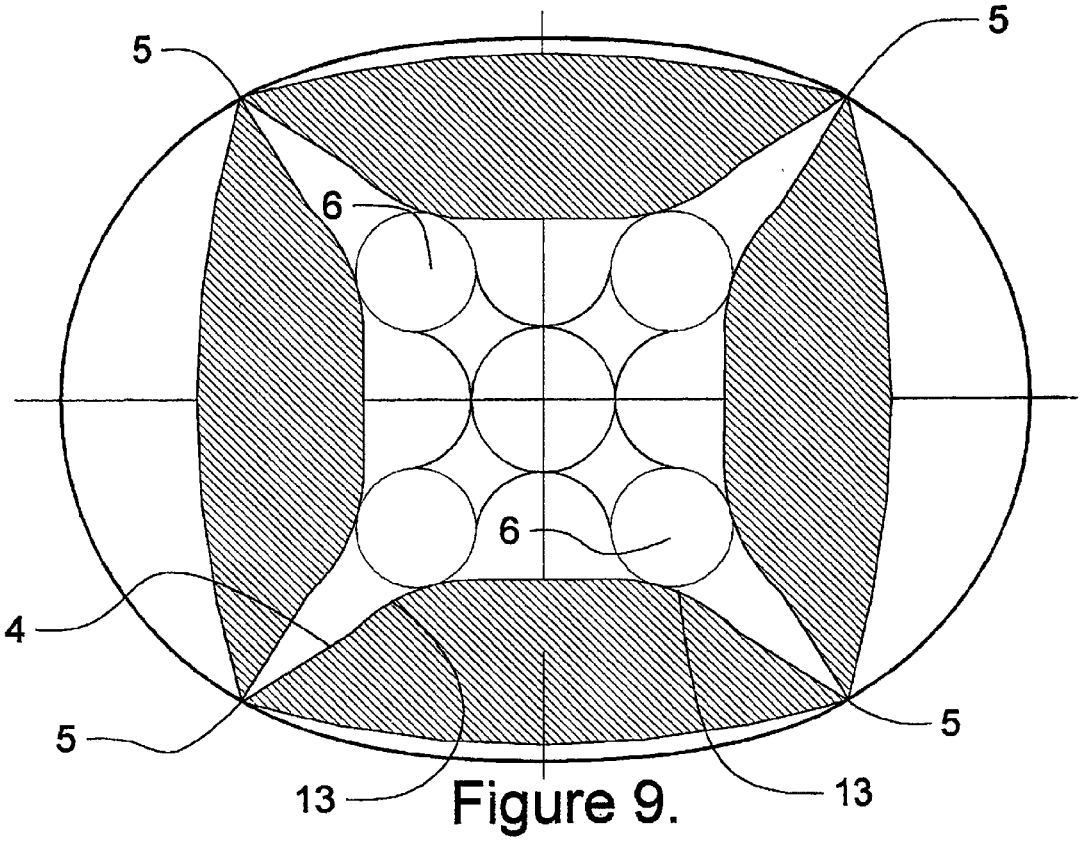
FIGS. 9 and 10 schematically illustrate a four-segmented hinged rotor assembly with point hinges in the square and rhombus orientations as well as details of the synchronized, direct contact power take-off crank mechanism.
Figure 10:
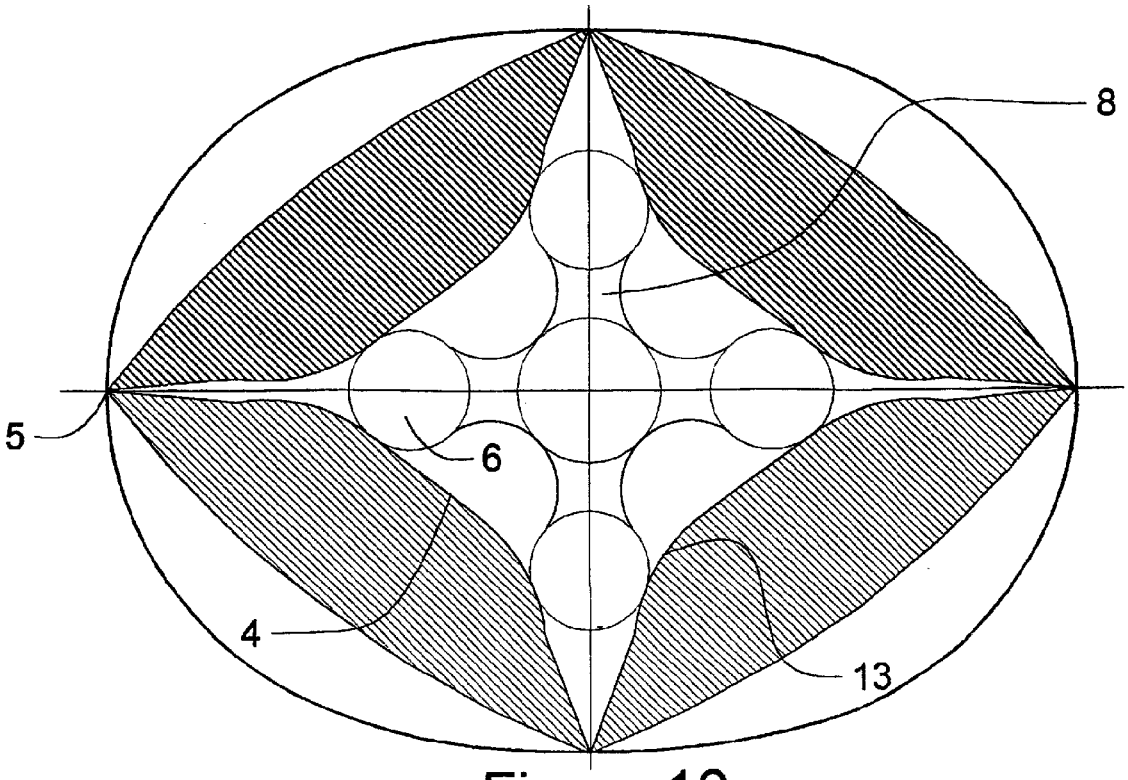
Figure 11:
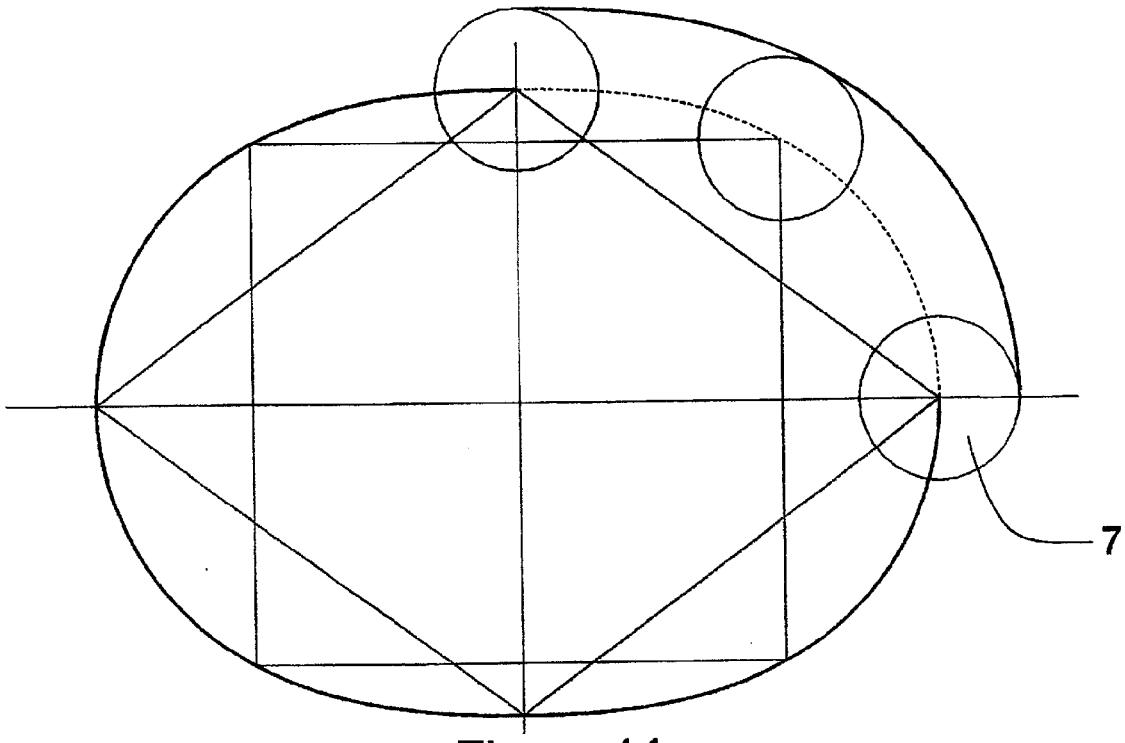
FIGS. 11 to 14 graphical illustrate the concept of modifying Szorenyi's curve to accommodate a rotor assembly with finite hinge diameters, as opposed to the theoretical zero diameter point hinges.
Figure 12:
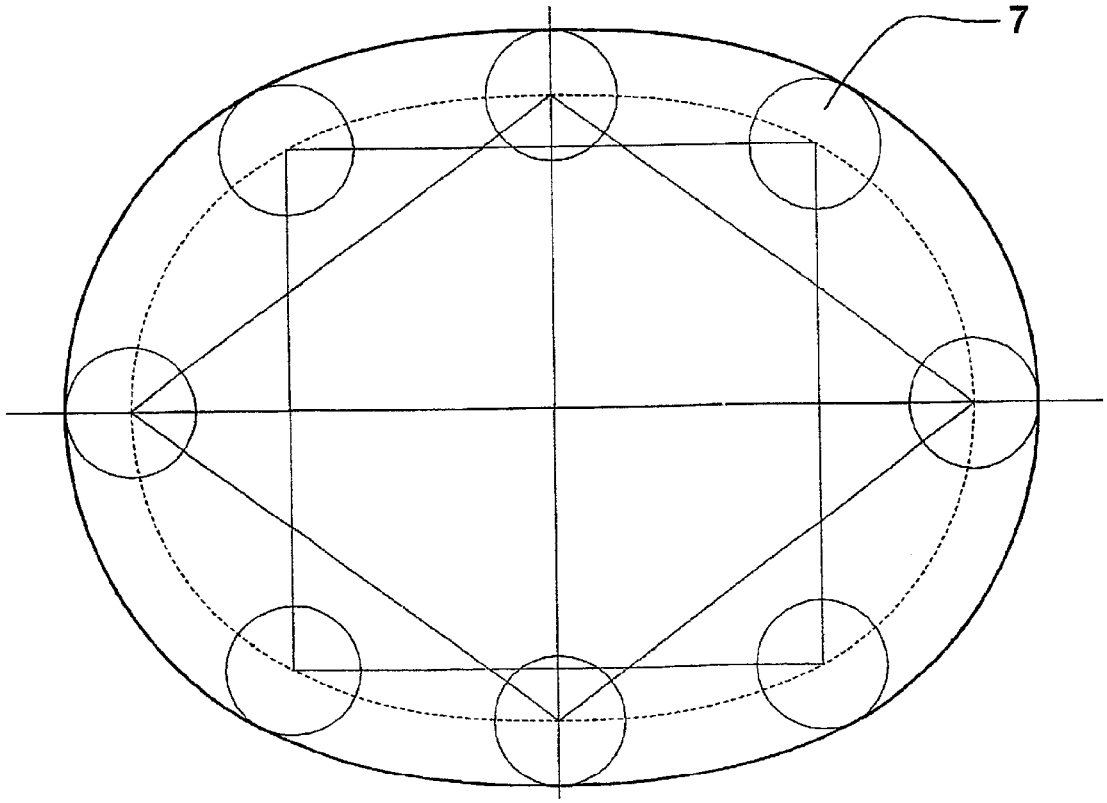
Figure 13:
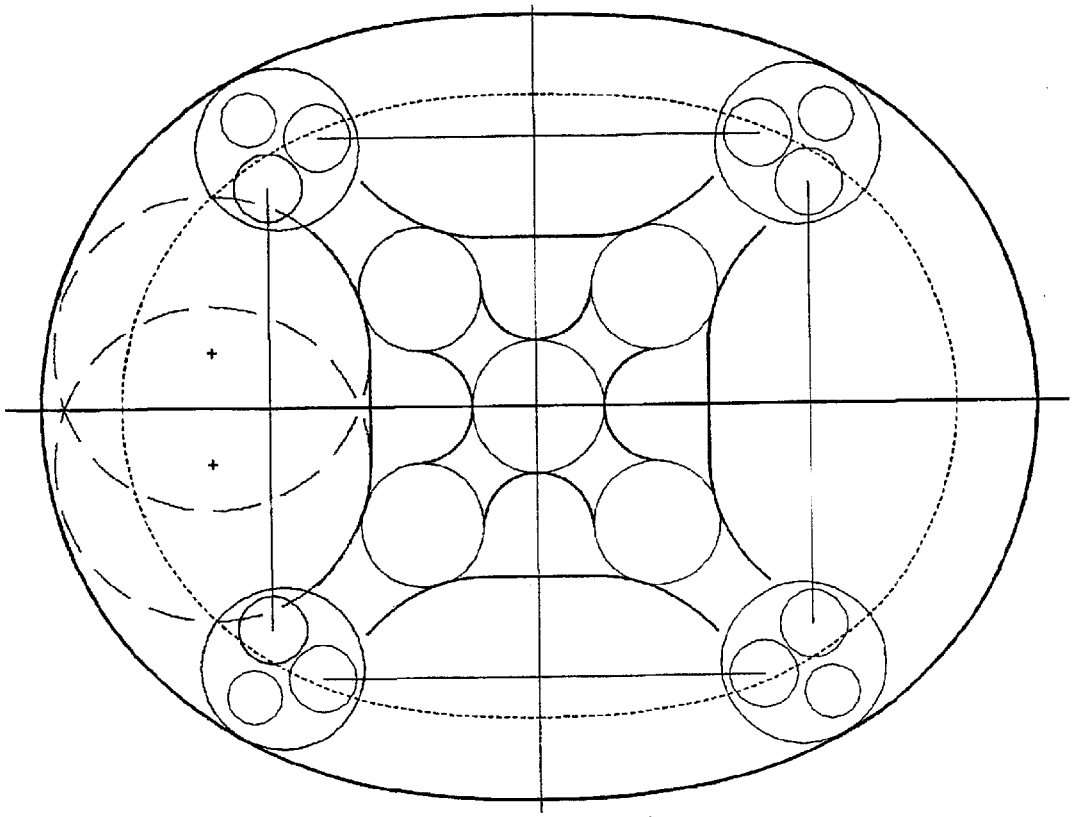
Figure 14:
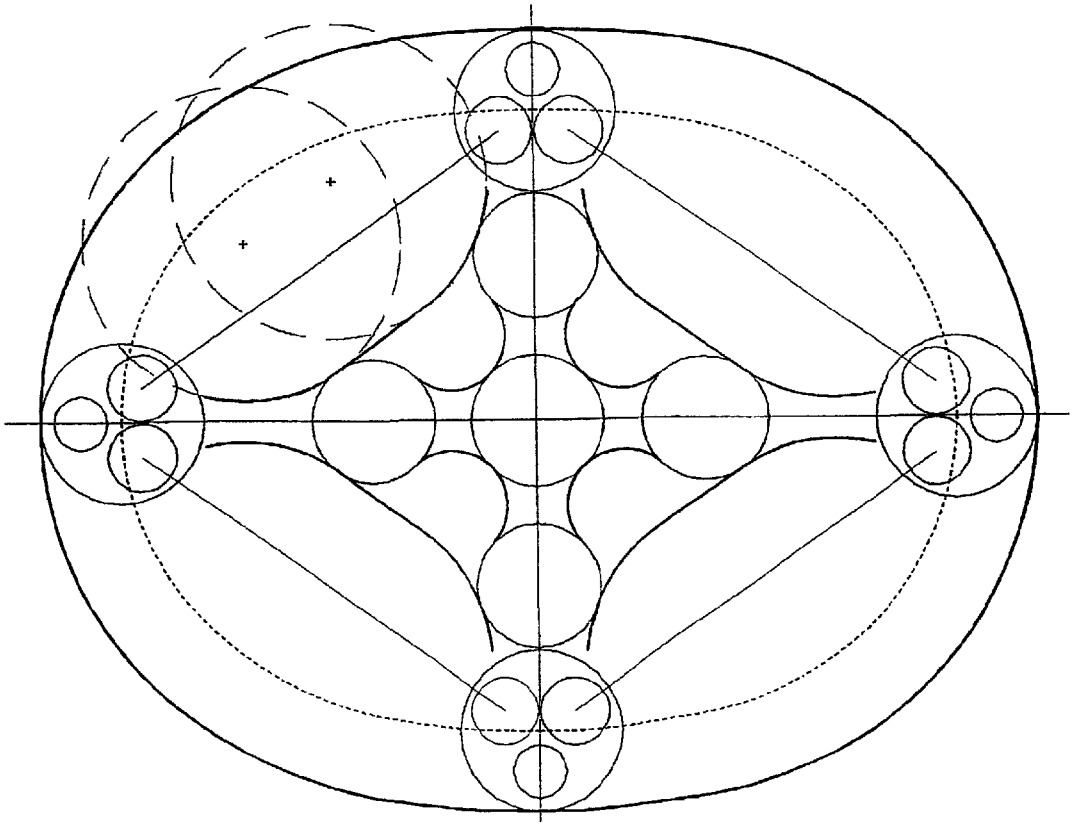

In the description of Szorenyi's curve above, the sides of the equilateral parallelogram (equivalent to the four rotor segments that are continuously accommodated within the confines of the rotor housing) are hinged at four points 5. In other words, the hinge pin diameters are infinitely small and hence imaginary. The basic concept is illustrated in FIGS. 9 and 10. The inner faces of rotor segments 4 incorporate two lobes having cylindrical contours 13 that remain in constant contact with the four crankpins 6 and provide the power transfer mechanism.

For a practical application the hinge pin diameter has to be finite and non-zero. To accommodate the case of non-zero hinge pin diameters, the curve requires modification by expanding it outwards along the normal to Szorenyi's curve at every point by an amount equal to the radius of a finite hinge pin 7. The resultant curve is known as the "Modified Szorenyi's Curve" which forms the basis of practical embodiments. The concept is illustrated in FIGS. 11, 12, 13 and 14.

General Engine Characteristics

In the Otto cycle configuration of the hinged rotor internal combustion rotary engine, there are four power strokes for each complete revolution of the rotor assembly and crankshaft. This characteristic provides a power output equivalent (at identical RPM) to a V-8 conventional piston engine with each cylinder having a cubic displacement equal to the maximum capacity of the rotary engine's chamber. As one working chamber undergoes the expansion cycle producing work, the following one is in the compression phase being readied to fire. This continuity of power strokes provides relatively constant torque, unlike conventional engines. The four-segment hinged rotor assembly 1 is balanced at all rotational angles and the axisymmetric crankshaft 8 is also completely balanced, minimising engine rotational vibration. As power and torque are comparatively high even at low RPM, the engine is ideally suited for directly driving the propellers of aircraft, obviating the need for a reduction gearbox. Direct coupling of the engine to a motor vehicle's drive train may also be feasible. The balanced nature of the rotating gear does not require a flywheel. As a consequence, and because of the potentially lightweight rotor assembly, the engine is expected to be highly responsive providing rapid acceleration.

There are few moving parts and the engine does not require pressurised oil lubrication or a sump. The crankshaft can be externally supported by sealed roller/ball bearings or carbon/graphite journal bearings. The self-lubricating nature of these bearings makes pressurised lubrication and a sump redundant. Advanced materials such as oil impregnated sintered iron, carbon, graphite, adaptable metal reinforced carbon composites and ceramics may be used to provide self-lubricating solutions. The application of Diamond Like Carbon (DLC) coatings to engine components would also reduce the dependence on lubricants.

The gas seals are similar to those used in Wankel type rotary engines. These may not require additional lubrication if self-lubricating materials are used. However, if necessary, seal lubrication can be derived from the charge mixture containing a small fraction of lubricating oil.

The hinged rotor engine requires no valves or associated valve train and "D" shaped apposite intake ports could be cut into each of the two rotor flat-plate side covers. The peripheral exhaust port located in the rotor housing could have a circular or oval cross section. For improved volumetric efficiency, a peripheral intake port could be employed instead of the side cover intake port(s). As in conventional piston engines, the hinged rotor engine's "valve" timing allows some intake/exhaust overlap for scavenging efficiency. There needs to be no unintentional overlap of intake and exhaust ports, direct fuel injection, supercharging and turbo boost may all be employed. The rapid expansion of combustion products would reduce the production of nitrous oxides, lowering undesirable emissions. The engine could run on a variety of fuels, including natural gas and hydrogen. The ignition system is conventional and initiates combustion through a single spark plug. High compression ratios permitting Diesel operation are achievable through varying the rotor segment face radius of curvature and/or shape. Hemispherical cavities may be machined into rotor segment faces to increase intake capacity and provide a combustion chamber shape closer to the spherical ideal.

Cooling of the rotor housing (or stator) may be effected through cooling fins cast or machined into the housing. In larger and more powerful embodiments the stator may be liquid cooled. The rotor assembly is cooled by the charge and additional cooling may be provided by cooling fins machined into the inner surfaces of the rotor segments and by the natural or forced circulation of cooling air through the central core of the engine. Forced circulation of cooling air may be achieved through fan blades attached to the crankshaft or rotor segments. Cooling air entry into and exit from the engine's central core may be controlled through openings cut into the two flat-plate side covers and ducts.

Lightweight materials can be employed in construction including aluminium alloys, and ceramic materials to minimise engine weight and achieve high power-to-weight ratios. These engine characteristics would conserve construction materials and energy, as well as reduce fuel consumption in practical installations. Perceived applications for smaller, directly air-cooled engines are light aircraft, UAVs, hybrid road vehicles, portable generating sets, lawnmowers, hand-held machinery and motorcycles. More powerful, and probably liquid cooled, engines could propel larger vehicles. A number of engine units could be joined to a common crankshaft for even greater power output and degree of redundancy.

Internal Combustion Engine Embodiments

In a smaller and simpler air-cooled embodiment, engine power transfer is achieved by a crankshaft having two perpendicular fixed arms that accommodate four equispaced, circularly disposed crankpins. During rotor rotation, each of the four crankpins remains in constant sliding contact with the convex cylindrical internal contour of the two adjacent rotor segments. The judicious choice of crankpin and rotor materials and/or coatings would obviate the need for lubrication. The sliding friction between crankpins and rotor segments may be substituted with rolling friction. In such a configuration rollers mounted on the four equispaced, circularly disposed crankpins would remain in constant contact with the internal contour of the two adjacent rotor segments. Swivelling roller segments mounted on the four equispaced, circularly disposed crankpins may also have gear teeth, meshing with corresponding gear teeth cut in the internal contour of the two adjacent rotor segments. The crankpins need not be solid but may be hollow to save weight. Additionally, as crankpin contact with the rotor segment is limited to a small arc, the crankpin need not be a complete solid or hollow cylinder, but may be a segment thereof, or an individual crankpin may be replaced by two smaller diameter crankpins.

Figure 15:
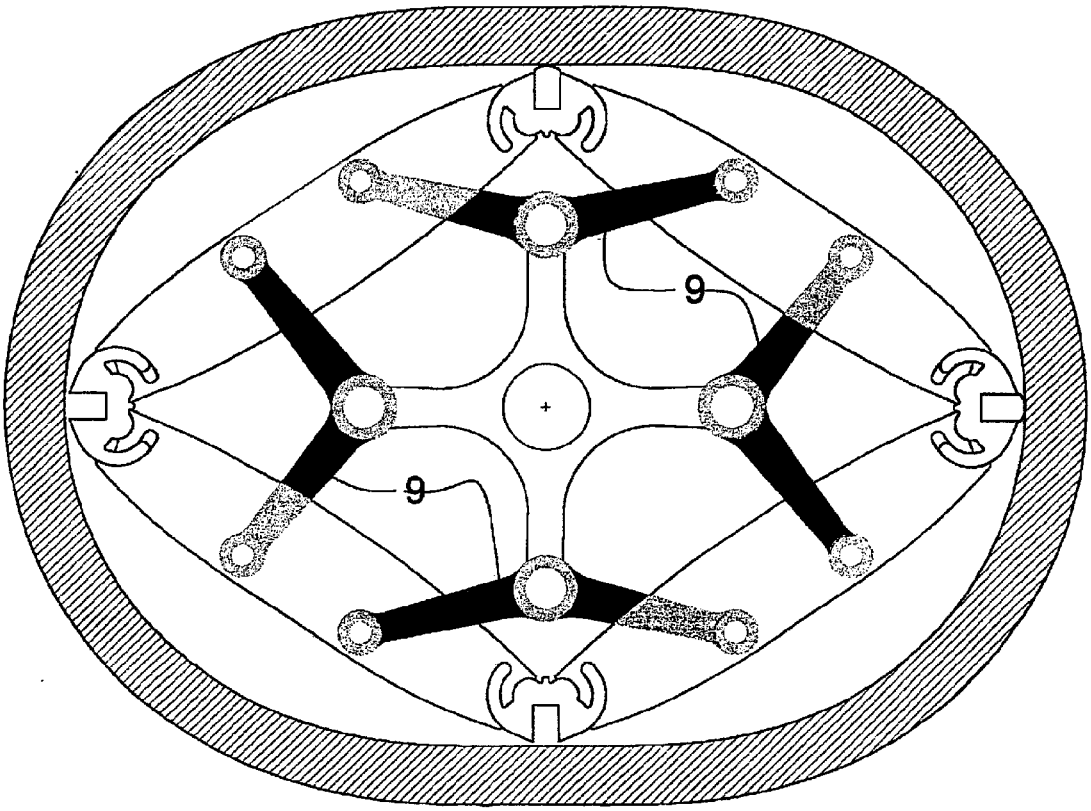
FIGS. 15 and 16 schematically illustrate a variant of the synchronized power take-off crank mechanism using crank arms instead of direct sliding contact.
Figure 16:
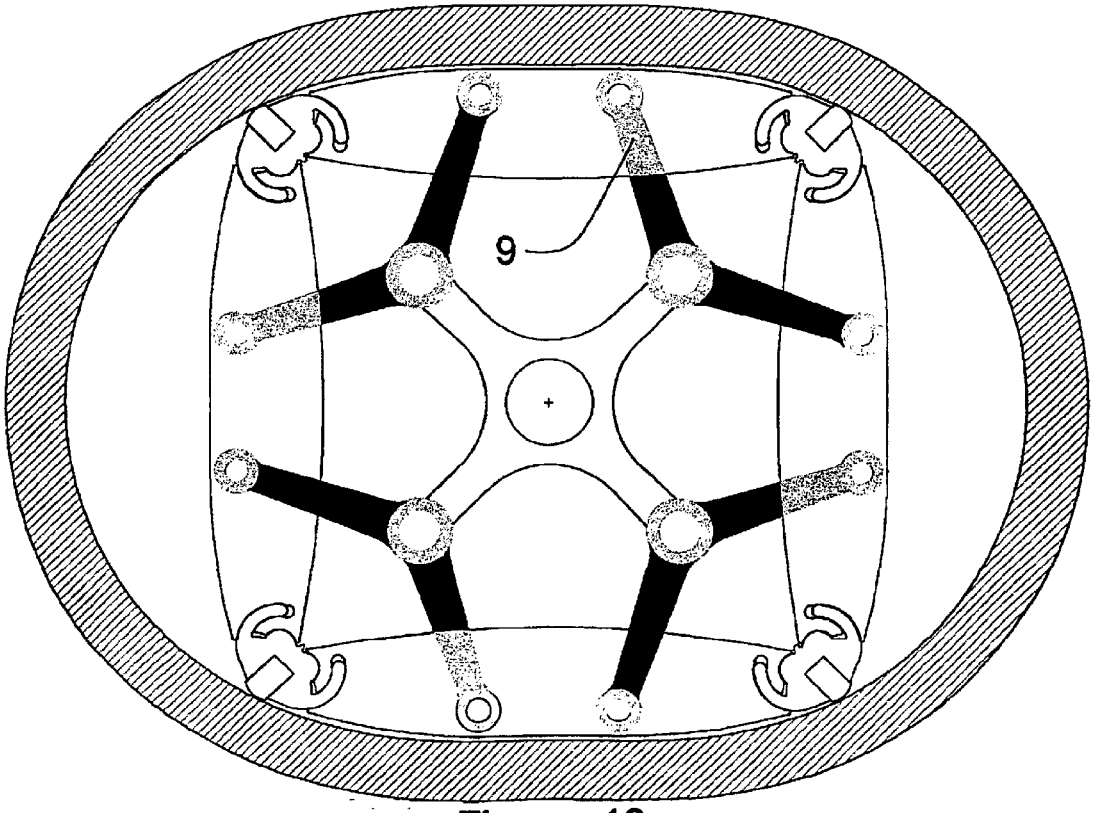

A larger and more robust embodiment of the engine may utilise a liquid cooled rotor housing and crankarms joining rotor segments to crankshaft crankpins. Observing the fact that these crankarms only oscillate (and not fully rotate) in a small arc around both the rotor segment and crankpin attachment points, pre-lubricated crankarms and crankshaft bushings may be adequate. Alternatively, conventional dry-sump pressurised lubrication could be employed if necessary. The positioning of crankarm attachment points to rotor segments is critical and must coincide with the longitudinal axes of the cylindrical lobes of rotor segments. This method of attaching the rotor segments to the crankshaft is illustrated in FIGS. 15 and 16. The four pairs of identical crankarms 9 would be alternately attached to the top and bottom halves of the four equispaced, circularly disposed crankpins.

Details of Preferred Embodiment

Figure 17:
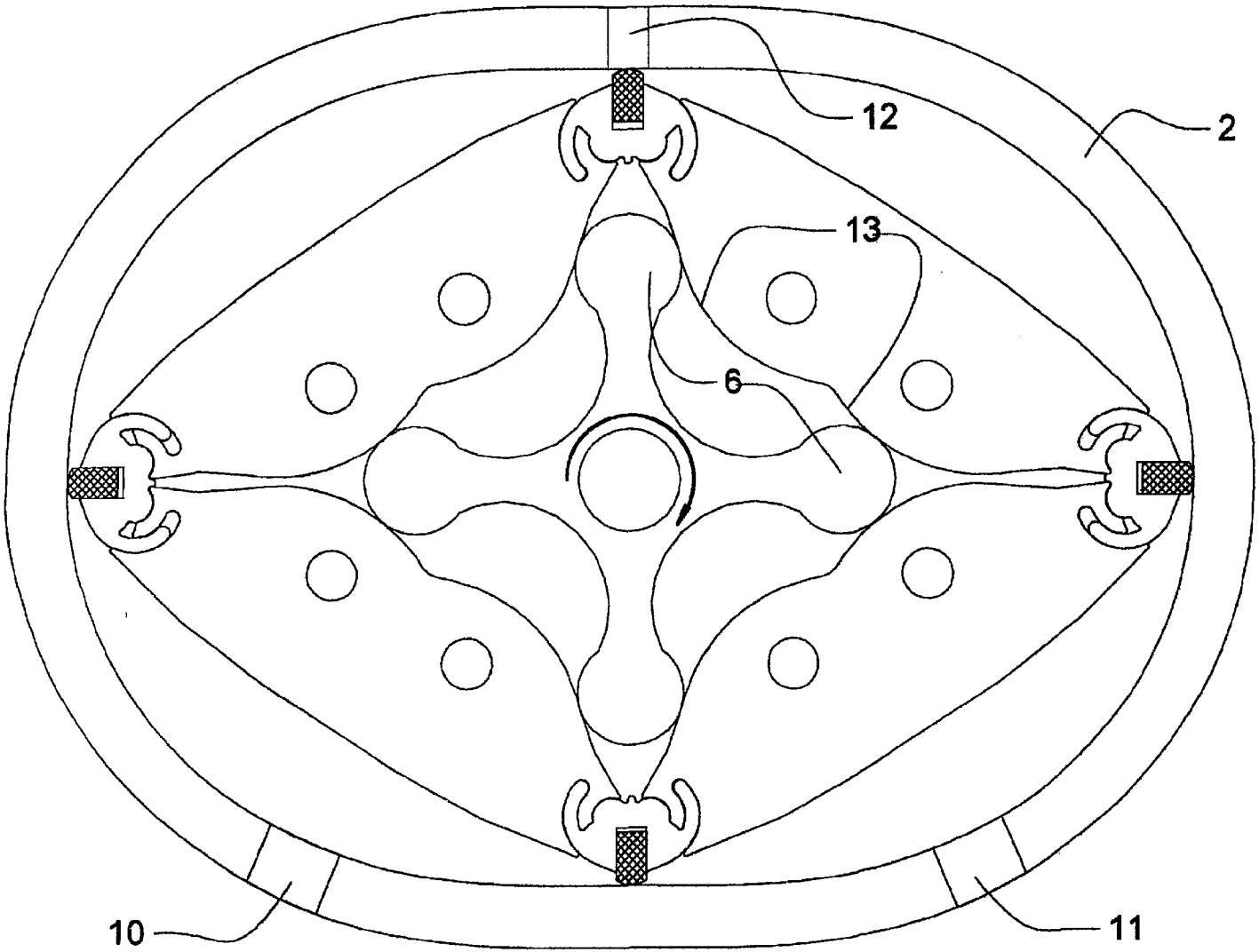
FIGS. 17 and 18 schematically illustrate the internal combustion embodiment of the rotary apparatus of the present invention.
Figure 18:
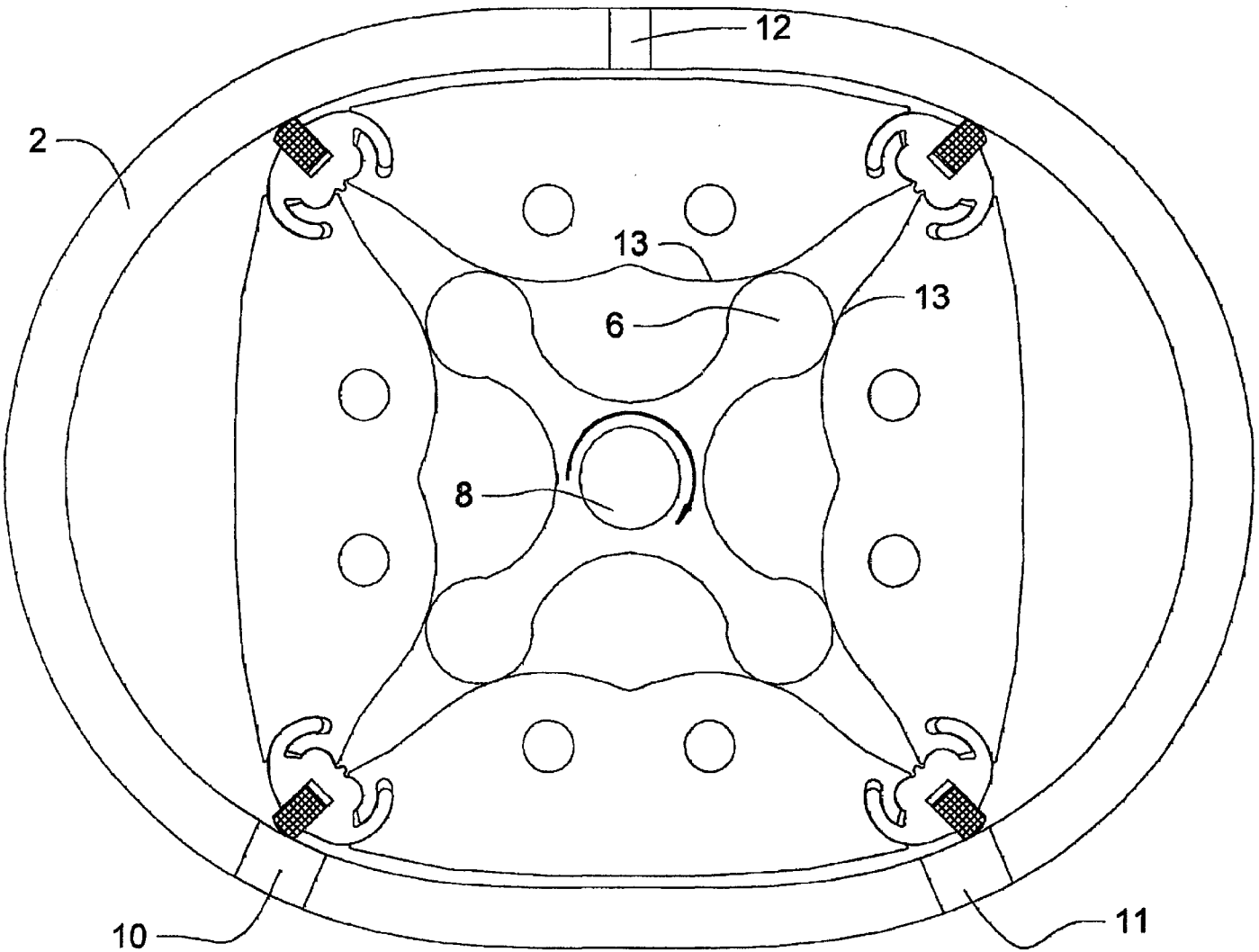

Plan view schematics of the preferred implementation of the engine are at FIGS. 17 and 18. Engine rotation is clockwise, as shown by the arrows. The figures also indicate the positioning of the peripheral inlet port 10, peripheral exhaust port 11 and spark plug hole 12 in the rotor housing 2. Power transfer is directly obtained through rotor segment convex cylindrical inner profiles 13 bearing on the crankpins 6, with which they are in constant sliding contact. The following sections provide detailed descriptions of engine components.

Rotor Segments

Figure 19:
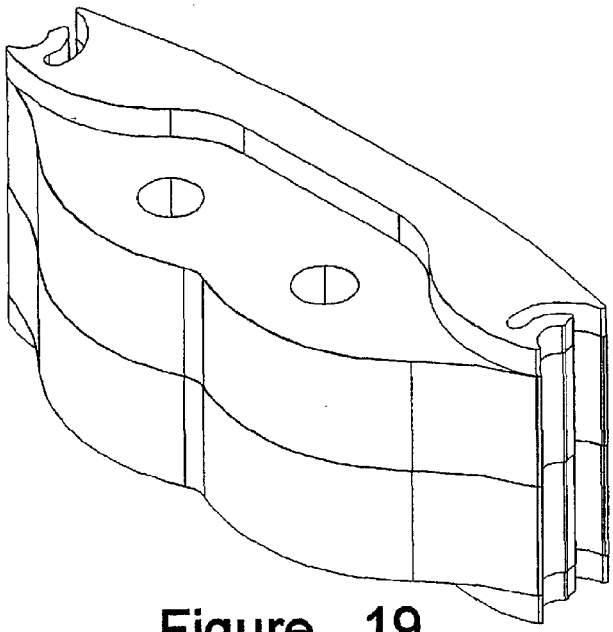
FIGS. 19 to 21 are perspective view of details of hinged rotor assembly components for the preferred embodiment of the invention.

Rotor segment outer faces 14 are convex to produce the desired compression ratio of maximum to minimum working chamber volumes required for operation in the internal combustion engine mode. Rotor segment inner surfaces have convex cylindrical contours 13 for the direct transfer of motive power by being in continuous contact with the crankpins 6 attached to the crankshaft 8. A computer application program is used to calculate the required convex cylindrical rotor segment contours for any combinations of rotor housing and rotor assembly dimensions, crank and crankpin radii. A typical rotor segment is shown in FIG. 19.

Anchor Blocks

Figure 20:
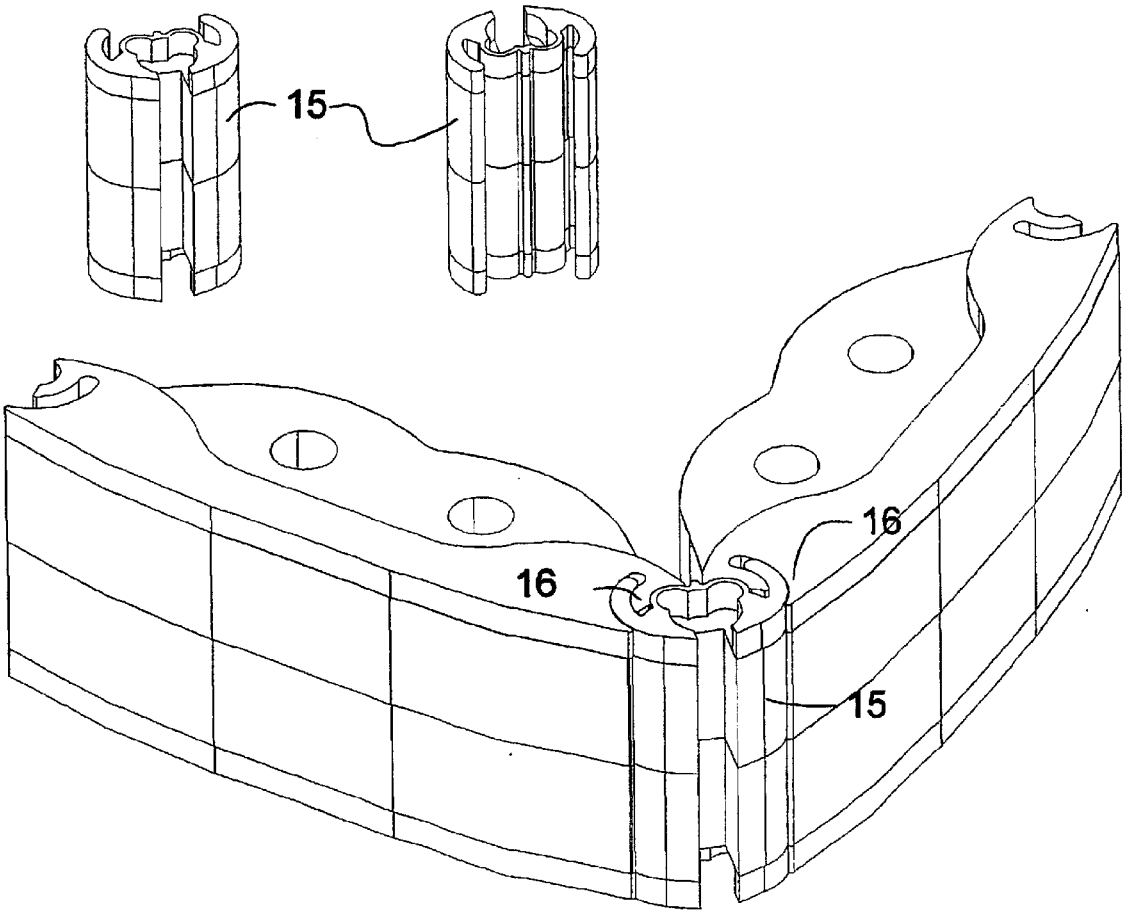

The tips of each adjacent pair of rotor segments are joined with an "anchor block" 15; front and rear views shown in FIG. 20. The figure also illustrates the way each anchor block holds the tips of adjacent rotor segments 16 in a pivoting labyrinth arrangement, providing a gas-tight seal. This method of attachment permits articulated movement of one rotor segment relative to the other, and relative to the anchor block. The four anchor blocks are essential components of the hinged rotor assembly in linking the four rotor segments and also providing receptacles for gas seals.

Seals

Figure 21:
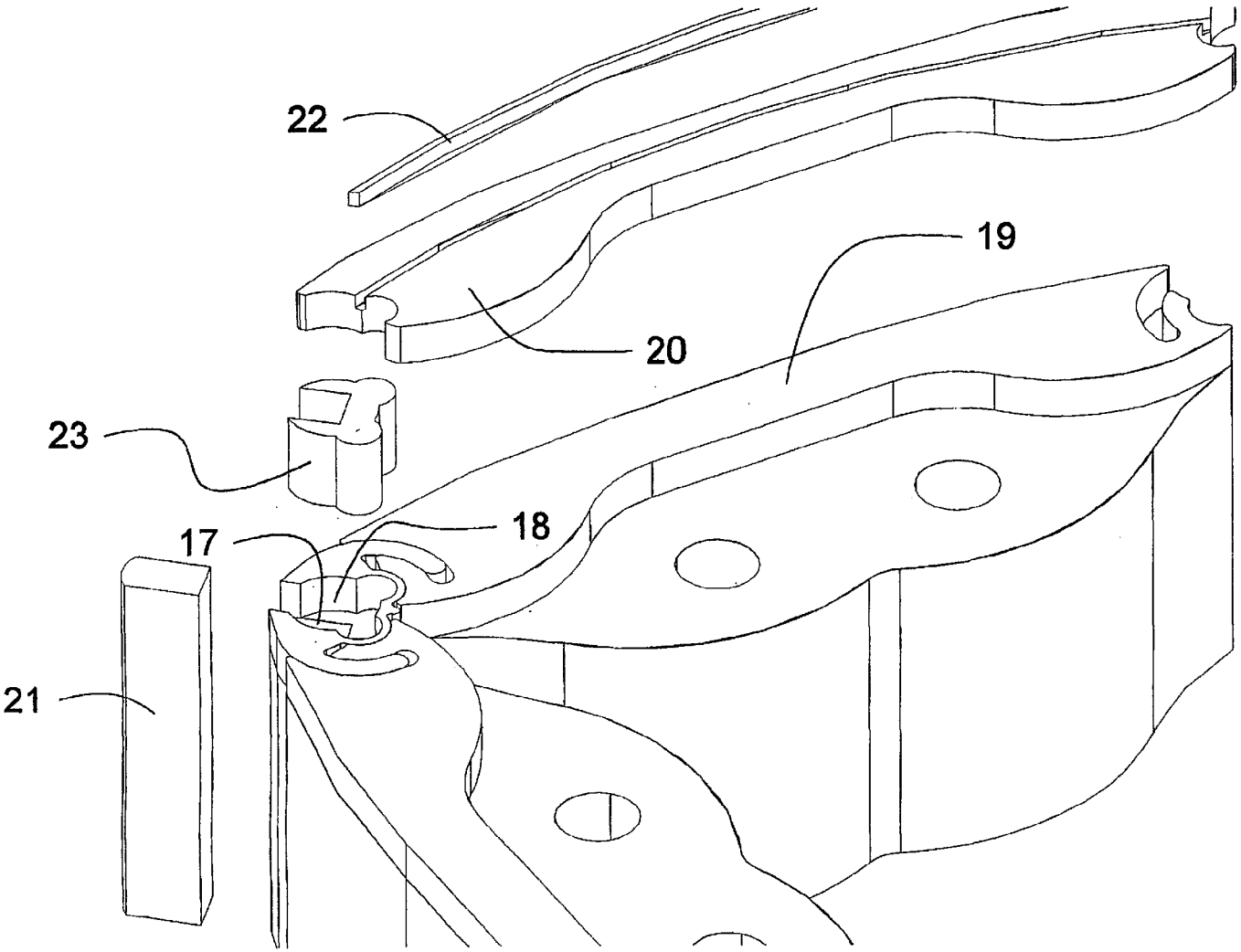

Each anchor block incorporates a radially outward facing axial apex seal/seal spring slot 17 and top and bottom corner seal/seal spring cavities 18. Each complete rotor segment comprises the rotor segment body 19 and firmly attached top and bottom closure plates 20. These integral closure plates lock-in the anchor blocks and contain grooves for the side seals and side seal springs. The corresponding disposition of conventional apex 21, side 22 and corner 23 seals in the anchor block/rotor segment assembly is shown in the exploded view of FIG. 21.

Crankshaft

The described method of direct power transfer from rotor segments to crankpins ensures that crankshaft rotation is synchronised with the rotation of the rotor assembly apices (hinges). If power transfer were effected by linking the crankshaft to the midpoints (P) of rotor segments (which are always on the inscribed circle of radius c/2), rotation of the crankshaft would become irregular. This irregularity results from the non-uniform rotation/translation of the rotor segment midpoints around the inscribed circle in relation to the constant rotation of the rotor assembly apices.

Figure 22:
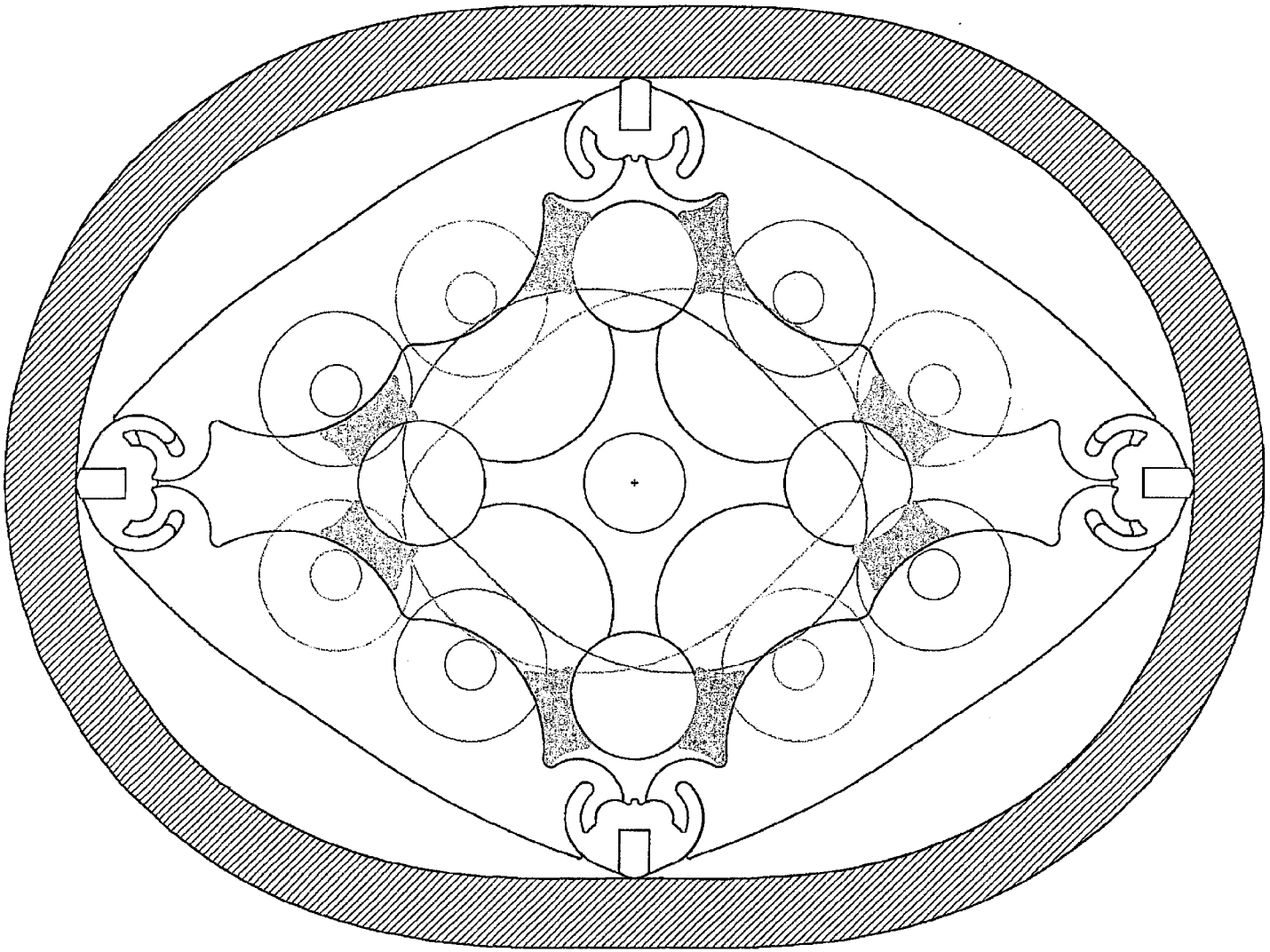
FIG. 22 schematically illustrates another variant of the synchronized power take-off crank mechanism using sliding blocks that provide an increased surface area interface between crankpins and the cylindrical lobes of rotor segments.

Double-concave, open-face bearing blocks may be inserted between the convex cylindrical rotor segment inner profiles and crankpins to increase contact surface area and reduce loading. These bearing blocks may be made from a self-lubricating material (such as carbon-graphite) and may consist of scarf-jointed segments to compensate for wear. The concept is illustrated in FIG. 22.

Being in sliding contact only, the crankshaft is axially decoupled from the rotor assembly. Therefore, the rotor assembly is not subjected to any lateral (axial) load. Simple thrust washers mounted on the crankshaft shoulders may be employed to bear any axial load acting on that component, for instance load that may result from the clutch being depressed in automotive applications.

Guide Tracks and Followers

Figure 23:
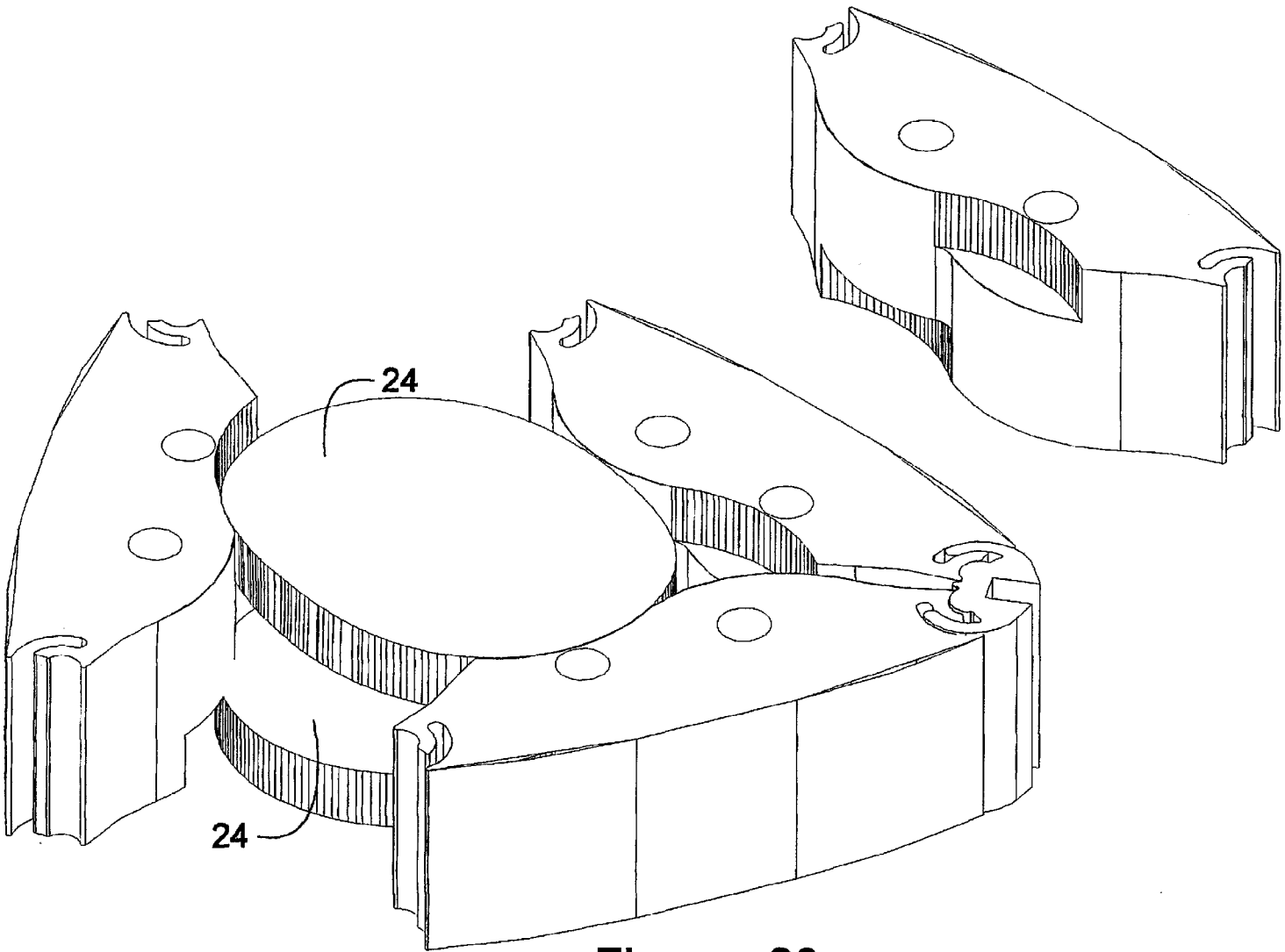
FIG. 23 is a perspective view of the configuration where, during rotation of the rotor assembly, rotor segments remain in direct sliding contact with appropriately shaped guide tracks.

For efficient functioning, only the spring-loaded seals (apex, corner and side) should be in sliding contact with the rotor housing and flat-plate side covers. To ensure that the hinged rotor assembly shape continually adapts to the rotor housing internal profile without contacting it, the cylindrical internal contours of the rotor segments follow (slide along) guide tracks thus providing the required radial and lateral (or axial) clearances. The two convex guide tracks 24 are attached to the insides of the flat-plate side covers. This method of radial and axial restraint of the rotor assembly is illustrated in FIG. 23.

Figure 24:
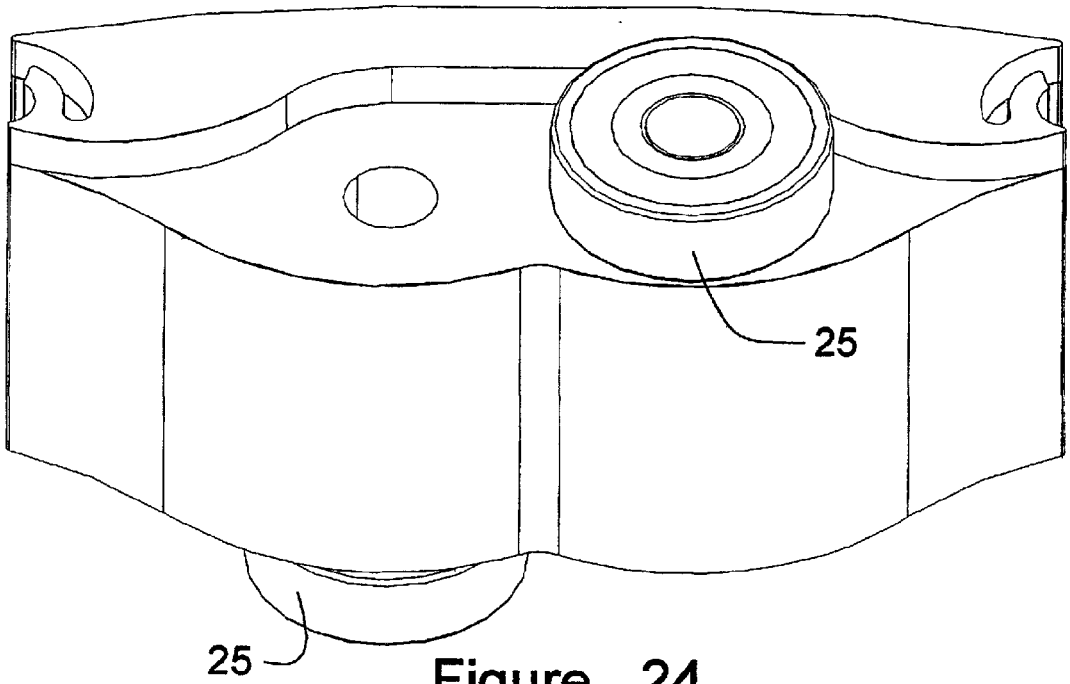
FIG. 24 is a perspective view of a rotor segment with track rollers attached.
Figure 25:
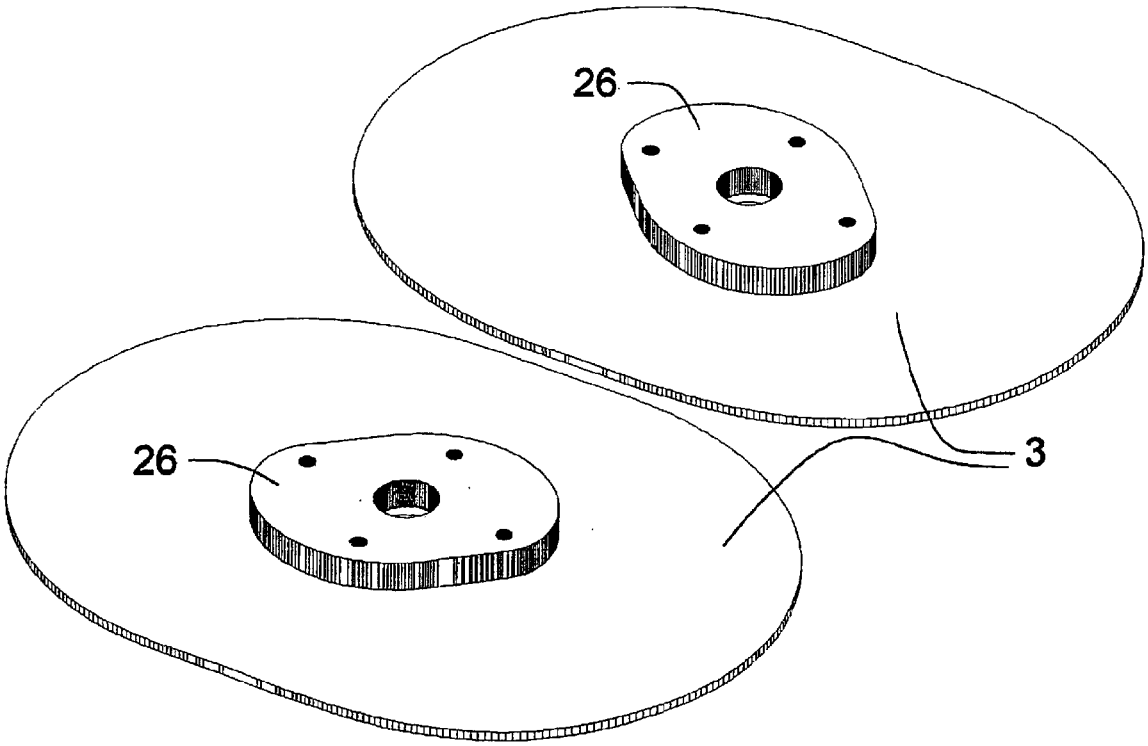
FIGS. 25 to 27 are perspective views of details of the guide tracks attached to the flat-plate side covers, their relative orientation and means of providing axial restraint to the rotor assembly by limiting the axial movement of track rollers attached to the rotor segments.
Figure 26:
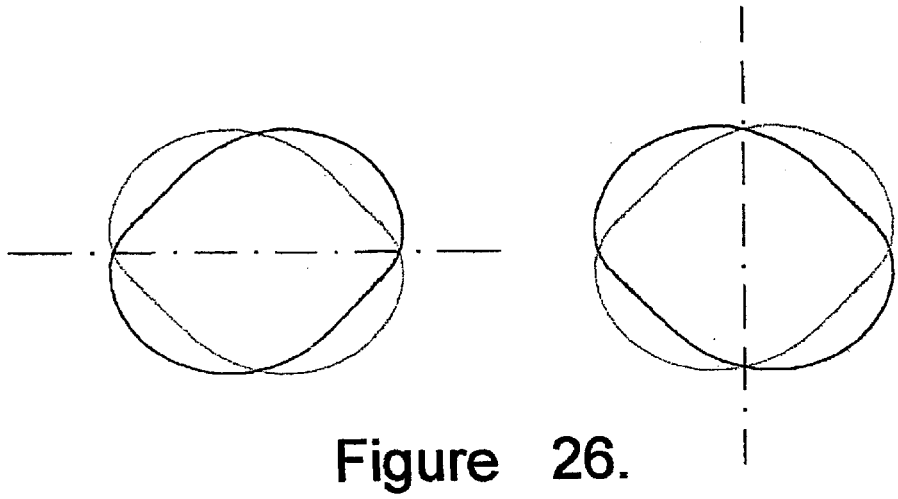

In the preferred embodiment of the engine, a system of track rollers 25 and associated tracks 26 is employed. Two track rollers, one on either side, are mounted on each rotor segment as shown in FIG. 24. The roller shafts are inserted in corresponding axial holes in the rotor segment bodies. The position and diameter of track rollers are optimised to ensure that the corresponding track profile has a gradually changing convex curvature and that the rotational speed of track rollers is not excessive. Track plates are internally attached to each of the two flat-plate side covers 3, illustrated in FIG. 25. The tracks are not identical; the second track profile is obtained by rotating the first one through 180°, either about the x-axis or the y-axis. The symmetric relationship between guide tracks is shown in FIG. 26. Pinion gears that mesh with corresponding gear teeth cut into the circumferences of tracks may be substituted for track rollers and smooth tracks.

Figure 27:
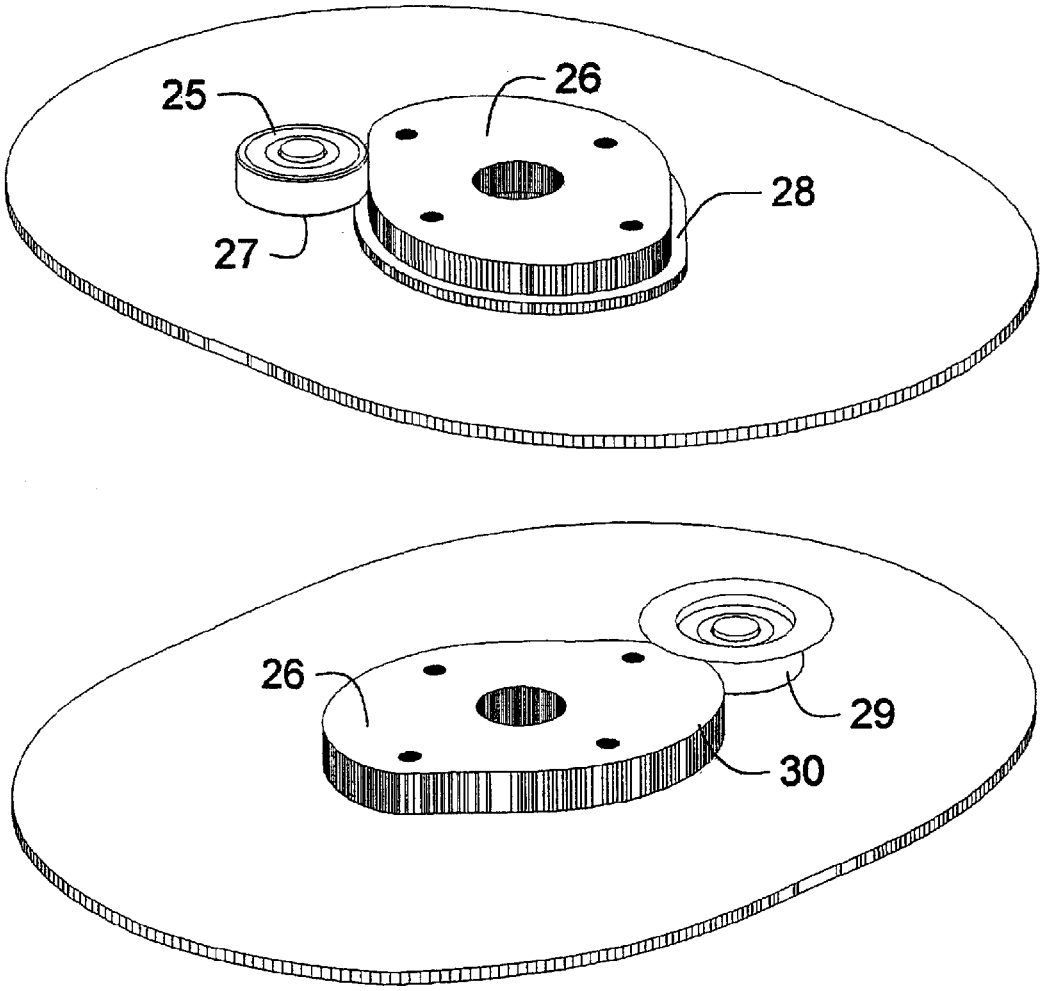

The track rollers also provide lateral (or axial) positioning for the rotor assembly, relative to the rotor housing and flat-plate side covers. This function is achieved by permitting the rims 27 of the track rollers 25, attached to the rotor segments, to ride on the extended base platform 28 of the track 26. Alternatively, flanged rollers 29 may be used riding on the inner profile edge 30 of the track 26. These arrangements, shown in FIG. 27, ensure that the required clearance between rotor sides and flat-plate side covers is maintained.

Figure 28:
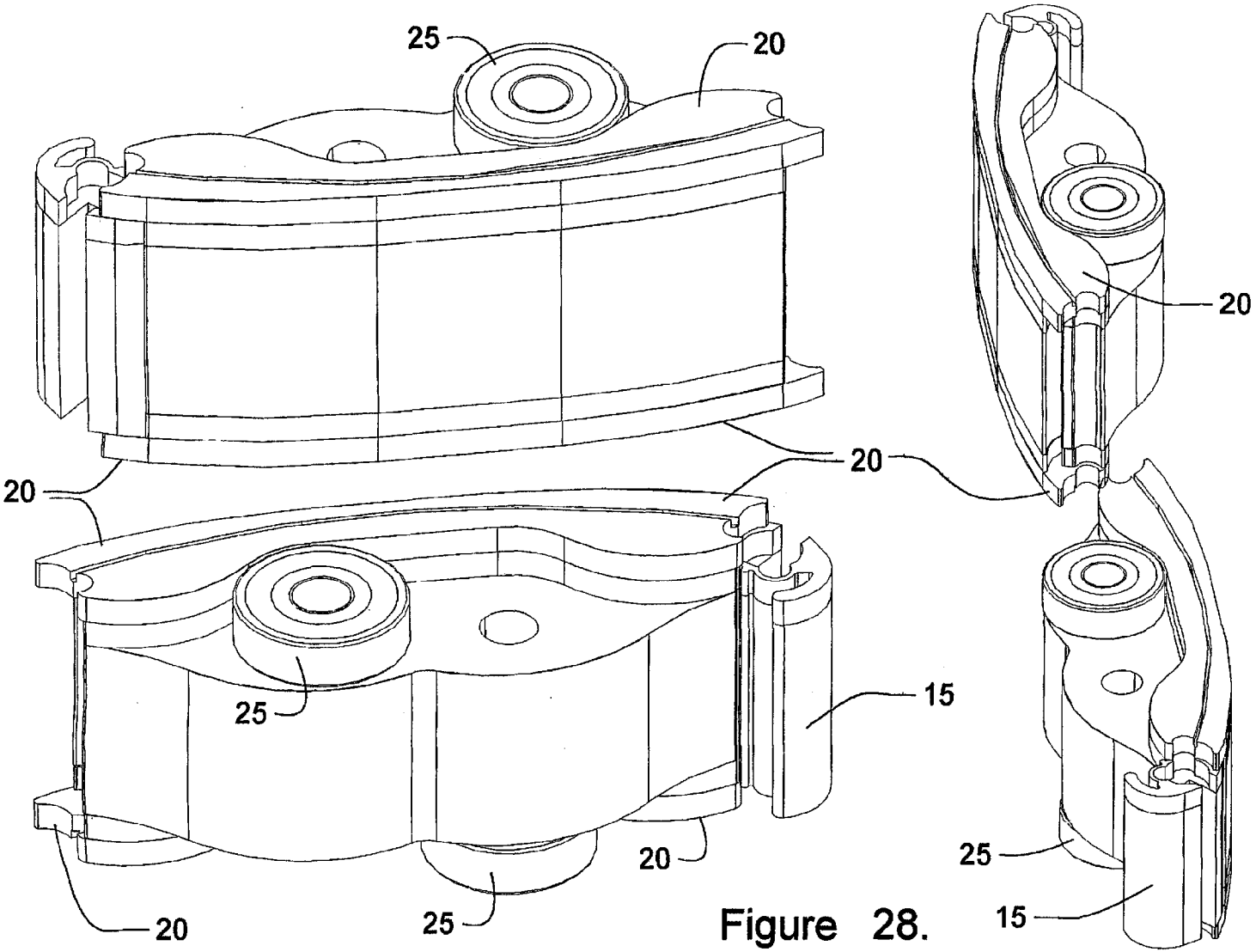
FIG. 28 is a perspective view of a rotor segment assembly with track rollers, rotor segment top/bottom plates and a hinge.

The combination of anchor blocks, rotor segments, crankpins (in constant contact with the rotor segment inner contours) and track rollers riding on corresponding tracks provides a firm radial fix for the rotor assembly, essential to provide clearance between the rotor and the rotor housing internal wall at all times. The configuration of a complete rotor segment, attached track rollers 25, affixed top and bottom closure plates 20 and linked anchor block 15 is shown in FIG. 28.

Assembled Views of the Preferred Embodiment

Figure 29:
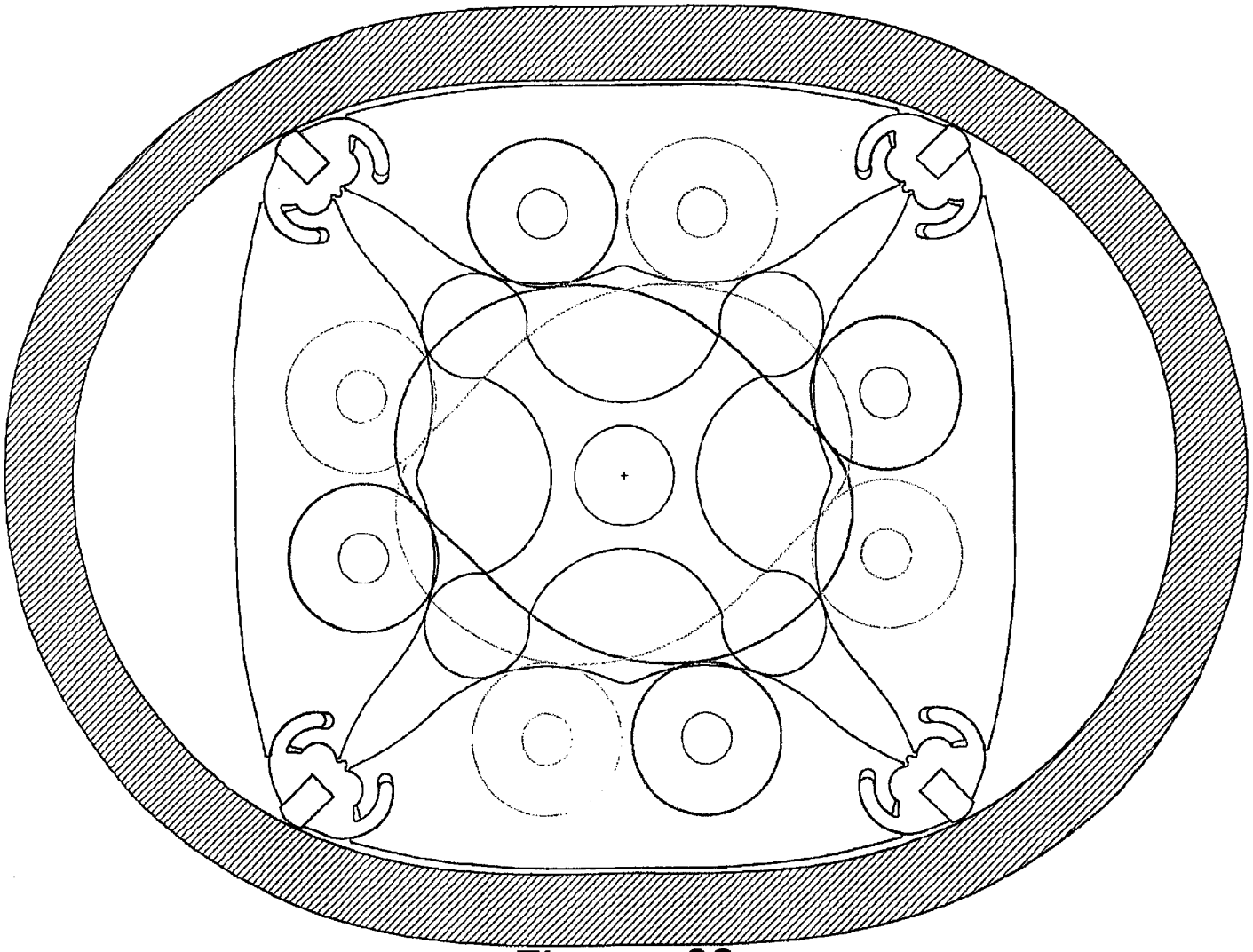
FIGS. 29 and 30 schematically illustrate the interaction of track rollers and guide tracks as the hinged rotor assembly rotates.
Figure 30:
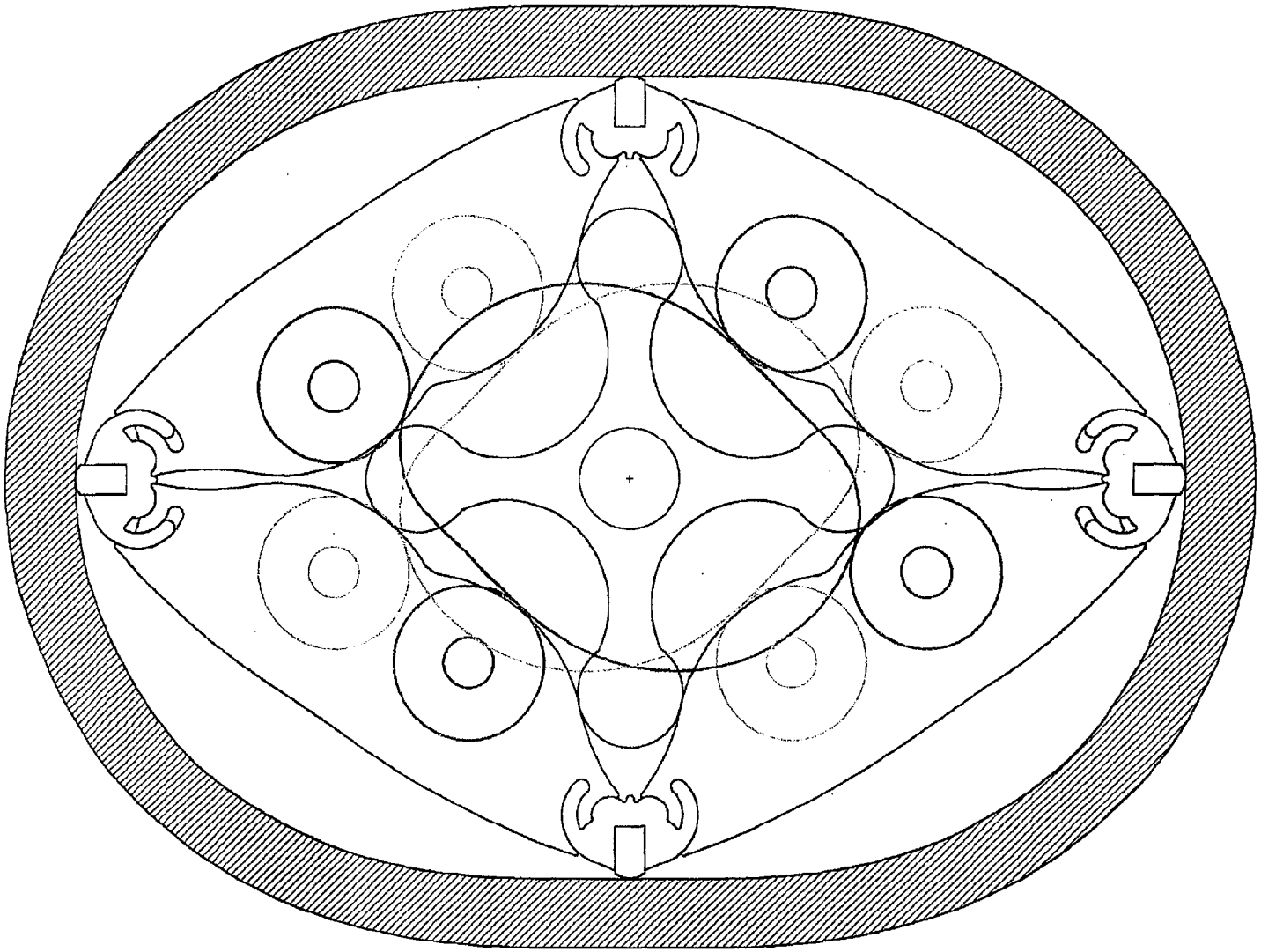
Figure 31:
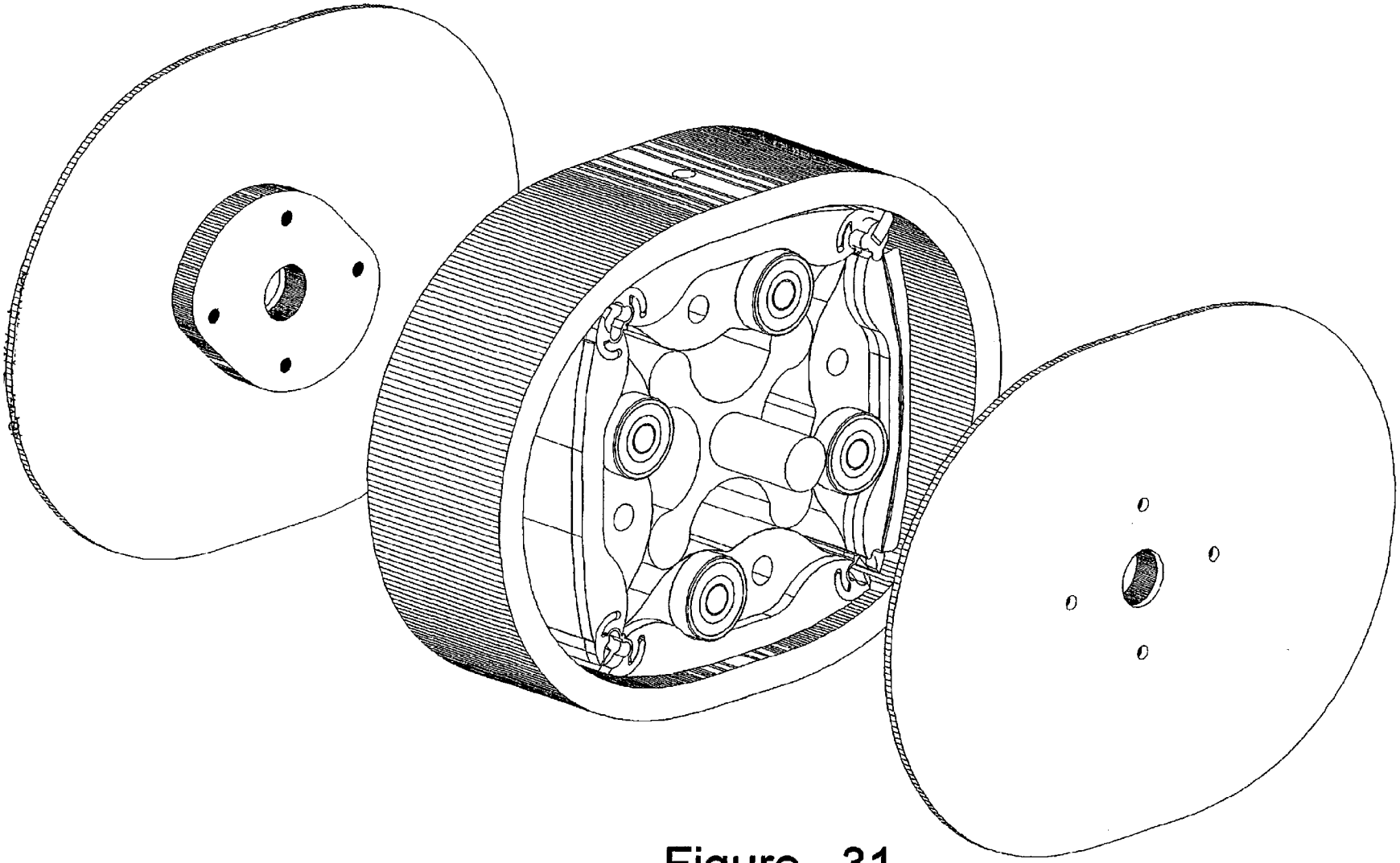
FIG. 31 is a perspective view of a hinged rotor internal combustion engine according to the present invention with the flat-plate side covers, and attached track roller guide tracks, removed.

Plan views of the engine are in FIGS. 29 and 30, showing the assembled parts, including track rollers and associated tracks. Finally, a perspective of major engine components is provided in FIG. 31. The figure, with one of the rotor segments in the top dead centre position, illustrates the relationship between assembled engine components. The flat-plate side covers and attached tracks are removed for clarity.

The claims defining the invention are as follows:

1. A rotary apparatus comprising:

a hinged rotor assembly having rotor segments, with each said rotor segment having opposite tips, said opposite tips defining:

points A and B, and a point P midway therebetween, and a right isosceles triangle including points A and B and having a vertex point C inside of said hinged rotor; and a coaxial rotor housing in which said hinged rotor is housed for rotation, said rotor housing including two flat-plate side covers and an internal profile, the internal profile being:

generally oval so as to define an X major axis and a Y minor axis which intersect at an origin point O, defined by having point P of each rotor segment moving along a circle with a center at origin point O and with a radius equal to one half of a distance between points A and B, and defined by having vertex point C always located on one of four lobes of the curve $$r=\sin[2(\theta+45°)]$$

where:

angle θ is the angle between the line connecting points O and A and a positive portion of axis Y, and angle θ is also the angle between the line connecting points O and B and a positive portion of axis X, and r equals the length of the line connecting points O and C.

2. An rotary apparatus as claimed in claim 1, wherein each rotor segment has an internal contour including two convex cylindrical lobes.

3. A rotary apparatus as claimed in claim 2, further comprising a direct power transfer system including a crankshaft and associated crankpins, each said crankpin remaining in constant contact with associated convex cylindrical lobes of adjacent said rotor segments.

4. A rotary apparatus as claimed in claim 3, wherein the respective tips of adjacent said rotor segments are linked with an associated anchor block permitting articulated movement of one said rotor segment relative to the adjacent said rotor segment, and relative to the associated anchor block.

5. A rotary apparatus as claimed in claim 3, wherein said crankpins include rollers which remain in constant contact with the convex cylindrical lobes of adjacent said rotor segments.

6. A rotary apparatus as claimed in claim 5, wherein said rollers have gear teeth which mesh with corresponding gear teeth cut in the internal convex cylindrical lobes of adjacent said rotor segments.

7. A rotary apparatus as claimed in claim 3, wherein the power transfer system includes identical crankarms which connect the crankpins of the crankshaft with associated said rotor segments at attachment points whose positions coincide with longitudinal axes of the convex cylindrical lobes of said rotor segments.

8. A rotary apparatus as claimed in claim 7, wherein said crankarms alternately extend from the top and bottom halves of associated crankpins of said crankshaft.

9. A rotary apparatus as claimed in claim 2, wherein the hinged rotor assembly is radially and axially constrained by having the convex-cylindrical lobes of said rotor segments directly follow guide tracks internally fixed to the flat-plate side covers.

10. A rotary apparatus as claimed in claim 2, where the hinged rotor assembly is radially and axially constrained by a system of track rollers mounted on the convex cylindrical lobes of said rotor segments and guide tracks internally fixed to the flat-plate side covers.

11. A rotary apparatus as claimed in claim 2, wherein the hinged rotor assembly is radially and axially constrained by a system of pinions mounted on the convex cylindrical lobes of said rotor segments and toothed guide tracks internally fixed to the flat-plate side covers.

12. A rotary apparatus as claimed in claim 1, wherein intake and exhaust ports are cut into one or both of said rotor housing flat-plate side covers.

13. A rotary apparatus as claimed in claim 1, wherein one or more intake ports are cut into one or both of said rotor housing flat-plate side covers and a peripheral exhaust port is cut into the rotor housing.

14. A rotary apparatus as claimed in claim 1, wherein a peripheral intake port and a peripheral exhaust port are cut into the rotor housing.

15. A rotary apparatus as claimed in claim 1, wherein said rotor segments are joined by either spring-steel strips or a single continuous spring-steel band, thereby obviating the need for discrete hinges while also assisting in sealing working chambers created by said rotor segments.

16. A steam engine based on the rotary apparatus as claimed in claim 1.

17. A pump based on the rotary apparatus as claimed in claim 1.

18. A compressor based on the rotary apparatus as claimed in claim 1.

19. A hydraulic or pneumatic motor based on the rotary apparatus claimed in claim 1.

20. An executable computer code based on the rotary apparatus embodying the mathematical relationship of claim 1, which is used to design rotary apparatus rotor housing internal profiles.

21. An executable computer code based on the rotary apparatus embodying the mathematical relationship of claim 1, which is used to manufacture rotary apparatus rotor housings.

22. A rotary engine comprising:

a hinged rotor assembly having rotor segments, wherein each said rotor segment has an internal contour including two convex lobes;

a coaxial rotor housing in which said rotor assembly is enclosed, said rotor housing having two opposed flat-plate side covers and a rotor housing internal profile; and a direct power transfer system including a crankshaft and associated crankpins, each said crankpin remaining in constant contact with associated convex lobes of adjacent said rotor segments.

* * * * *